US007476153B2

(12) United States Patent
Walker et al.

(10) Patent No.: US 7,476,153 B2
(45) Date of Patent: Jan. 13, 2009

(54) SYSTEM AND METHOD FOR REMOTE AUTOMATED PLAY OF A GAMING DEVICE

(75) Inventors: Jay S. Walker, Ridgefield, CT (US); James A. Jorasch, Stamford, CT (US); Geoffrey M. Gelman, Stamford, CT (US); Jose A. Suarez, Fairfield, CT (US); Thomas M. Sparico, New York, NY (US)

(73) Assignee: Walker Digital, LLC, Stamford, CT (US)

( * ) Notice: Subject to any disclaimer, the term of this patent is extended or adjusted under 35 U.S.C. 154(b) by 0 days.

(21) Appl. No.: 11/424,000

(22) Filed: Jun. 14, 2006
(Under 37 CFR 1.47)

(65) Prior Publication Data

US 2006/0287070 A1 Dec. 21, 2006

Related U.S. Application Data

(63) Continuation of application No. 10/635,986, filed on Aug. 7, 2003, which is a continuation-in-part of application No. 10/159,722, filed on May 30, 2002, now Pat. No. 6,969,317, which is a continuation of application No. 09/879,299, filed on Jun. 12, 2001, now Pat. No. 6,634,942, which is a continuation-in-part of application No. 09/437,204, filed on Nov. 9, 1999, now Pat. No. 6,244,957, which is a continuation of application No. 08/774,487, filed on Dec. 30, 1996, now Pat. No. 6,012,983.

(51) Int. Cl.
*A63F 9/24* (2006.01)

(52) U.S. Cl. ..... 463/20

(58) Field of Classification Search ..... None
See application file for complete search history.

(56) References Cited

U.S. PATENT DOCUMENTS

| | | | | |
|---|---|---|---|---|
| 4,099,722 | A | 7/1978 | Rodesch et al. | |
| 4,157,829 | A | 6/1979 | Goldman et al. | |
| 4,317,957 | A | 3/1982 | Sendrow | 178/999 |
| 4,467,424 | A | 8/1984 | Hedges et al. | 364/412 |
| 4,494,197 | A | 1/1985 | Troy et al. | 364/412 |
| 4,531,187 | A | 7/1985 | Uhland | 364/412 |

(Continued)

FOREIGN PATENT DOCUMENTS

EP 0 032 410 A1 7/1981

(Continued)

OTHER PUBLICATIONS

Brochure, "Flying Bet Roulette" DEQ Casinos Ltd., undated, 2pp.

(Continued)

*Primary Examiner*—Corbett Coburn
*Assistant Examiner*—Omkar A. Deodhar

(57) ABSTRACT

A method according to one or more embodiments of the present invention provides for initiating an automated session, in which the automated session comprises a plurality of games, and receiving a first signal including a video representation of the automated session. The method also includes transmitting a second signal including the video representation of the automated session to a player communication device.

25 Claims, 13 Drawing Sheets

U.S. PATENT DOCUMENTS

| | | | | |
|---|---|---|---|---|
| 4,636,951 | A | 1/1987 | Harlick | 364/412 |
| 4,652,998 | A | 3/1987 | Koza et al. | 364/412 |
| 4,669,731 | A | 6/1987 | Clarke | 273/143 R |
| 4,689,742 | A | 8/1987 | Troy et al. | 364/412 |
| 4,698,564 | A | 10/1987 | Slavin | 318/257 |
| 4,755,941 | A | 7/1988 | Bacchi | 364/412 |
| 4,760,527 | A | 7/1988 | Sidley | 364/412 |
| 4,764,666 | A | 8/1988 | Bergeron | 235/380 |
| 4,837,728 | A | 6/1989 | Barrie et al. | 463/27 |
| 4,842,278 | A | 6/1989 | Markowitz | 273/237 |
| 4,856,787 | A | 8/1989 | Itkis | 273/237 |
| 4,880,237 | A | 11/1989 | Kishishita | 273/138 A |
| 4,951,039 | A | 8/1990 | Schwendeman et al. | 345/473 |
| 4,982,337 | A | 1/1991 | Burr et al. | 364/479 |
| 4,991,848 | A | 2/1991 | Greenwood et al. | 273/143 R |
| 5,038,022 | A | 8/1991 | Lucero | 235/380 |
| 5,042,809 | A | 8/1991 | Richardson | 273/138 |
| 5,069,453 | A | 12/1991 | Koza et al. | 463/17 |
| 5,083,271 | A | 1/1992 | Thacher et al. | 364/411 |
| 5,096,195 | A | 3/1992 | Gimmon | 273/138 |
| 5,112,050 | A | 5/1992 | Koza et al. | 463/17 |
| 5,119,295 | A | 6/1992 | Kapur | 364/412 |
| 5,123,649 | A | 6/1992 | Tiberio | 273/143 R |
| 5,178,390 | A | 1/1993 | Okada | 273/143 R |
| 5,179,517 | A | 1/1993 | Sarbin et al. | 364/410 |
| 5,223,698 | A | 6/1993 | Kapur | 235/375 |
| 5,239,165 | A | 8/1993 | Novak | 235/375 |
| 5,275,400 | A | 1/1994 | Weingardt et al. | 273/999 |
| 5,276,312 | A | 1/1994 | McCarthy | 235/380 |
| 5,277,424 | A | 1/1994 | Wilms | 273/999 |
| 5,283,734 | A | 2/1994 | Von Kohorn | 364/412 |
| 5,287,269 | A | 2/1994 | Dorrough et al. | 364/408 |
| 5,290,033 | A | 3/1994 | Bittner et al. | 463/25 |
| 5,324,035 | A | 6/1994 | Morris et al. | 273/138 |
| 5,330,185 | A | 7/1994 | Fioretti | 273/138 |
| 5,377,975 | A | 1/1995 | Clapper | 463/16 |
| 5,380,007 | A | 1/1995 | Travis et al. | 273/269 |
| 5,393,057 | A | 2/1995 | Marnell, II | 463/13 |
| 5,398,932 | A | 3/1995 | Eberhardt et al. | 273/138 |
| 5,401,024 | A | 3/1995 | Simunek | 273/138 A |
| 5,413,357 | A | 5/1995 | Schulze et al. | 463/5 |
| 5,415,416 | A | 5/1995 | Scagnelli et al. | 273/439 |
| 5,417,424 | A | 5/1995 | Snowden et al. | 273/138 |
| 5,429,361 | A | 7/1995 | Raven et al. | 273/138 A |
| 5,436,967 | A | 7/1995 | Hanson | 379/266 |
| 5,470,079 | A | 11/1995 | LeStrange et al. | 463/25 |
| 5,518,253 | A | 5/1996 | Pocock et al. | 273/439 |
| 5,536,008 | A | 7/1996 | Clapper | 463/16 |
| 5,551,692 | A | 9/1996 | Pettit et al. | 273/143 R |
| 5,564,700 | A | 10/1996 | Celona | 463/27 |
| 5,569,082 | A | 10/1996 | Kaye | 463/17 |
| 5,570,885 | A | 11/1996 | Ornstein | 463/27 |
| 5,580,311 | A | 12/1996 | Haste, III | 463/17 |
| 5,586,936 | A | 12/1996 | Bennett et al. | 463/25 |
| 5,595,538 | A | 1/1997 | Haste, III | 463/17 |
| 5,609,337 | A | 3/1997 | Clapper, Jr. | 273/138.2 |
| 5,613,912 | A | 3/1997 | Slater | 463/25 |
| 5,621,200 | A | 4/1997 | Irwin et al. | 235/375 |
| 5,634,012 | A | 5/1997 | Stefik et al. | 395/239 |
| 5,647,592 | A | 7/1997 | Gerow | 273/139 |
| 5,647,798 | A | 7/1997 | Falciglia | 463/19 |
| 5,651,548 | A | 7/1997 | French et al. | 273/309 |
| 5,657,899 | A | 8/1997 | Stoken | 463/17 |
| 5,697,844 | A | 12/1997 | Von Kohorn | 463/40 |
| 5,707,285 | A | 1/1998 | Place et al. | 463/12 |
| 5,735,432 | A | 4/1998 | Stoken et al. | 221/2 |
| 5,735,742 | A | 4/1998 | French | 463/25 |
| 5,741,183 | A | 4/1998 | Acres et al. | 463/42 |
| 5,743,800 | A | 4/1998 | Huard et al. | 463/26 |
| 5,749,784 | A | 5/1998 | Clapper, Jr. | 463/17 |
| 5,758,875 | A | 6/1998 | Giacalone, Jr. | 273/143 R |
| 5,762,552 | A | 6/1998 | Vuong et al. | 463/25 |
| 5,766,075 | A | 6/1998 | Cook et al. | 463/25 |
| 5,768,382 | A | 6/1998 | Schneier et al. | 380/23 |
| 5,770,533 | A | 6/1998 | Franchi | 463/42 |
| 5,772,509 | A | 6/1998 | Weiss | 463/16 |
| RE35,864 | E | 7/1998 | Weingardt | 463/28 |
| 5,779,549 | A | 7/1998 | Walker et al. | 463/42 |
| 5,781,647 | A | 7/1998 | Fishbine | 382/1 |
| 5,788,573 | A | 8/1998 | Baerlocher et al. | 463/16 |
| 5,800,268 | A | 9/1998 | Molnick | 463/40 |
| 5,803,808 | A | 9/1998 | Strisower | 463/11 |
| 5,816,917 | A | 10/1998 | Kelmer et al. | 463/16 |
| 5,816,918 | A | 10/1998 | Kelly et al. | |
| 5,816,919 | A | 10/1998 | Scagnelli et al. | 463/25 |
| 5,830,063 | A | 11/1998 | Byrne | 463/18 |
| 5,830,067 | A | 11/1998 | Graves et al. | 463/40 |
| 5,833,538 | A | 11/1998 | Weiss | 463/21 |
| 5,848,932 | A | 12/1998 | Adams | 463/20 |
| 5,871,398 | A | 2/1999 | Schneier et al. | 463/16 |
| 5,910,048 | A | 6/1999 | Feinberg | 463/25 |
| 5,915,588 | A | 6/1999 | Stoken et al. | 221/2 |
| 5,919,090 | A | 7/1999 | Mothwurf | 463/25 |
| 5,951,397 | A | 9/1999 | Dickinson | 463/36 |
| 5,970,143 | A | 10/1999 | Schneier et al. | 380/23 |
| 5,980,384 | A | 11/1999 | Barrie | 463/16 |
| 5,999,808 | A | 12/1999 | LaDue | 455/412.2 |
| 6,001,016 | A | 12/1999 | Walker et al. | 463/42 |
| 6,012,983 | A | 1/2000 | Walker et al. | 463/20 |
| 6,024,640 | A | 2/2000 | Walker et al. | 463/17 |
| 6,026,643 | A | 2/2000 | Begis | 60/533 |
| 6,050,895 | A | 4/2000 | Luciano, Jr. et al. | 463/7 |
| 6,077,163 | A | 6/2000 | Walker et al. | 463/26 |
| 6,139,430 | A | 10/2000 | Huard et al. | 463/16 |
| 6,146,270 | A | 11/2000 | Huard et al. | 463/12 |
| 6,168,522 | B1 | 1/2001 | Walker et al. | 463/25 |
| 6,193,606 | B1 | 2/2001 | Walker et al. | 463/20 |
| 6,203,428 | B1 | 3/2001 | Giobbi et al. | 463/16 |
| 6,234,900 | B1 | 5/2001 | Cumbers | 463/42 |
| 6,244,957 | B1 | 6/2001 | Walker et al. | 463/20 |
| 6,270,409 | B1 | 8/2001 | Shuster | 463/20 |
| 6,273,820 | B1 | 8/2001 | Haste, III | 60/533 |
| 6,299,533 | B1 | 10/2001 | Parra et al. | 463/17 |
| 6,306,038 | B1 | 10/2001 | Graves et al. | 463/40 |
| 6,315,662 | B1 | 11/2001 | Jorasch et al. | 463/20 |
| 6,318,721 | B1 | 11/2001 | Randall et al. | 273/148 |
| 6,319,127 | B1 | 11/2001 | Walker et al. | 463/26 |
| 6,331,144 | B1 | 12/2001 | Walker et al. | 463/20 |
| 6,343,989 | B1 | 2/2002 | Wood et al. | 463/23 |
| 6,389,538 | B1 | 5/2002 | Gruse et al. | 705/1 |
| 6,402,148 | B1 | 6/2002 | Saruwatari | 273/292 |
| 6,402,614 | B1 | 6/2002 | Schneier et al. | 463/17 |
| 6,508,709 | B1 | 1/2003 | Karmarker | 463/42 |
| 6,508,710 | B1 | 1/2003 | Paravia et al. | 463/42 |
| 6,527,638 | B1 | 3/2003 | Walker et al. | 463/25 |
| 6,605,001 | B1 | 8/2003 | Tarantino | 463/22 |
| 6,634,942 | B2 | 10/2003 | Walker et al. | 463/20 |
| 6,641,484 | B2 | 11/2003 | Oles et al. | 463/47 |
| 6,709,331 | B2 | 3/2004 | Berman | 463/16 |
| 6,722,983 | B2 | 4/2004 | Kaminkow et al. | 463/26 |
| 6,726,563 | B1 | 4/2004 | Baerlocher et al. | 463/25 |
| 6,733,389 | B2 | 5/2004 | Webb et al. | 463/20 |
| 6,755,741 | B1 | 6/2004 | Rafaeli | 463/25 |
| 6,769,983 | B2 | 8/2004 | Slomiany | 463/16 |
| 6,846,238 | B2 | 1/2005 | Wells | 463/39 |
| 6,896,616 | B2 | 5/2005 | Weiss | 463/20 |
| 6,926,605 | B2 | 8/2005 | Nguyen et al. | 463/20 |
| 6,935,949 | B1 | 8/2005 | Murphy | 463/20 |
| 6,969,317 | B2 | 11/2005 | Walker et al. | 463/40 |
| 7,008,317 | B2 | 3/2006 | Cote et al. | 463/16 |
| 7,076,652 | B2 | 7/2006 | Ginter et al. | 713/153 |
| 7,140,964 | B2 | 11/2006 | Walker et al. | 463/25 |
| 7,213,005 | B2 | 5/2007 | Mourad et al. | 705/64 |
| 2001/0031654 | A1 | 10/2001 | Walker et al. | 463/1 |

| | | | | |
|---|---|---|---|---|
| 2001/0039204 | A1 | 11/2001 | Tanskanen | 463/17 |
| 2002/0022512 | A1 | 2/2002 | Higurashi | 463/20 |
| 2002/0058542 | A1 | 5/2002 | Roethel et al. | 463/13 |
| 2002/0082775 | A1 | 6/2002 | Meadows et al. | 701/214 |
| 2002/0090986 | A1 | 7/2002 | Cote et al. | 463/16 |
| 2002/0112171 | A1 | 8/2002 | Ginter et al. | 713/194 |
| 2002/0125641 | A1 | 9/2002 | Moody | 273/292 |
| 2002/0143875 | A1 | 10/2002 | Ratcliff, III | 709/205 |
| 2002/0155875 | A1 | 10/2002 | Levitan | 463/17 |
| 2003/0024840 | A1 | 2/2003 | Rowe | 206/459 |
| 2003/0114217 | A1 | 6/2003 | Walker et al. | 463/20 |
| 2003/0144053 | A1 | 7/2003 | Michaelson | 463/25 |
| 2003/0162585 | A1 | 8/2003 | Gordon | 463/20 |
| 2003/0224854 | A1 | 12/2003 | Joao | 463/40 |
| 2003/0232651 | A1 | 12/2003 | Huard et al. | |
| 2005/0014553 | A1 | 1/2005 | Byrne | 463/18 |

FOREIGN PATENT DOCUMENTS

| | | | |
|---|---|---|---|
| EP | 0 106 187 | B1 | 11/1985 |
| EP | 0 405 776 | A2 | 1/1991 |
| EP | 0 478 412 | A1 | 4/1992 |
| EP | 0 487 446 | A2 | 5/1992 |
| FR | 2 697 653 | A1 | 5/1994 |
| FR | 2 815 214 | | 4/2002 |
| GB | 2 121 569 | | 12/1983 |
| GB | 2 148 135 | | 5/1985 |
| JP | 01258178 | A | 10/1989 |
| JP | 01269158 | A | 10/1989 |
| JP | 01269164 | A | 10/1989 |
| JP | 01316869 | | 12/1989 |
| JP | 02110660 | A | 4/1990 |
| JP | 03269763 | | 12/1991 |
| JP | 06-35944 | | 2/1994 |
| WO | WO 86/02752 | | 5/1986 |
| WO | WO 92/16914 | | 10/1992 |
| WO | WO 93/19428 | | 9/1993 |
| WO | WO 94/19906 | | 9/1994 |
| WO | WO 95/05876 | | 3/1995 |
| WO | WO 99/42964 | | 8/1999 |
| WO | WO 01/03786 | A | 1/2001 |
| WO | WO 01/48712 | | 7/2001 |
| WO | WO 01/69551 | A3 | 9/2001 |
| WO | WO 01/75824 | | 12/2001 |
| WO | WO 02/100494 | A1 | 12/2002 |
| WO | WO 03/017178 | A1 | 2/2003 |
| WO | WO 03/089086 | A1 | 10/2003 |
| WO | WO 03/089090 | A1 | 10/2003 |
| WO | WO 2004/014506 | A1 | 2/2004 |

OTHER PUBLICATIONS

Ritchie, Lauren "Orange Man Sought In Betting Probe", Orlando Sentinel Tribune, May 30, 1990 at p. B2, 3pp.

Mayo, Michael, "Win-Or-Lose-Cruise, You Can Bet Sports Legally Around Here—Just Wait Till The Boat Is 3 Miles Out", Sun-Sentinel, Dec. 28, 1994 at p. 1C, 3pp.

Cave, Kathy, "The Lake Effect", Milwaukee Journal Sentinel, Mar. 27, 1996 at p. 8, 2pp.

Busch, Melanie, "Tulsa Firm Explores Internet Gaming", Tulsa World, Aug. 1, 1996, Section: Business, p. E1, 3pp.

"Electronic Bingo System", Network Gaming International Corporation, (http://network-bingo com/bingo htm), downloaded date: Nov. 13, 1996, 5pp.

"MGAM Signs Agreement With Lac Vieux Desert Chippewa Tribe", Business Wire, May 18, 2001, 2pp.

"DEQ Casino—Flying Bet Roulette", (http //www deq com/ang/flying html), download date: Nov. 24, 2002, 1pg.

"GameCast Live—Home", (http //www gamecastlive com/), download date: Nov. 24, 2002, 1pg.

"GameCast Live—About the Product", (http //www gamecastlive com/about_the product html), download date: Nov. 24, 2002, 1pg.

"GameCast Live—PowerPoint Presentation", (http //www gamecastlive com/presentation/toronto2_files/frame htm), download date: Nov. 24, 2002, 1pg.

"GameCast Live—Press Release", (http //www gamecastlive com/press_june_6 html), download date: Nov. 24, 2002, 2pp.

"Welcome—i2corp.com", (http //www i2corp com/), download date: Nov. 24, 2002, 1pg.

"Games—i2corp.com", (http //www i2corp com/games/index cfm), download date: Nov. 24, 2002, 2pp.

"The Home Gambling Network—Welcome", (http //www homegamblingnetwork com), download date: Nov. 24, 2002, 1pg.

"The Home Gambling Network—Players", (http //www homegamblingnetwork com/player php3), download date: Nov. 24, 2002, 2pp.

"Multimedia Games, Inc.—Home", (http www betnet com/), download date: Nov. 24, 2002, 1pg.

Office Action for U.S. Appl. No. 10/635,986 mailed May 25, 2007, 8 pp.

Office Action for U.S. Appl. No. 11/424,009 mailed May 25, 2007, 6 pp.

"Harrah's Reno Uses Hybrid ISDN to Attract Customers", View text, Phillips Publishing, In., Mar. 1989, vol. 10, No. 3., ISSN: 0275-0686, 2pp.

Agent Speaks Directly to the Customer on the Screen', ISDN News, Phillips Publishing In., Mar. 1, 1989, vol. 2, No. 4, ISSN: 0899-9554, 2pp.

Conniff, Michael, "Don't Bet Against Harrah's When it Comes to ISDN", Electronic Service Update, LINK Resources Corp., May 1, 1989, Vo. 2, No. 5., 3pp.

"Interactive Network (IN) Announced Tues . . . " Communications Daily, Warren Publishing, Inc., Nov. 30, 1994, vol. 14, No. 230, ISSN: 0277-0679, 1 pg.

"Interactive Network Sets Up Gaming Subsidiary", Interactive Facts, SCTT Marketing Inc., Dec. 1994, vol. 1, No. 25, 3pp.

"Interactive Network Launches Wagering Unit", Multimedia Business Report, Dec. 12, 1994, ISSN: 1065-8300, 1pg.

"Interactive Network Forms Real-Time Gambling Subsidiary", Newsbytes News Network, Newsbytes, Dec. 1, 1994, 2pp.

Dvorak, John, "Gambling on a PC Near You", PC Magazine, May 16, 1995, vol. 14, No. 9, p. 89, ISSN: 0888-8507, 1pg.

Murray, Raphel, "Casinos Gamble On Direct Mail; Atlantic City Casinos; Retail; Industry Overview", Direct Marketing Magazine, Feb. 1992, vol. 54, No. 10, p. 32, ISSN: 0012-3188, 4pp.

Parets, Robyn Taylor, "The Newer DEAL", International Gaming and Wagering Business, Apr. 1997, Sec. p. 27, ISSN: 8750-8222, 4pp.

"TLC: The Secret World of Gambling: Casino Surveillance", Copyright 2000, The Discovery Channel, (http // www tlc discover com/tlcpages/gambling/eyesky thml), 2 pp.

"Mimio™ Turns a Dry Erase Board into an Electronic Whiteboard", Dukane Corporation Audio Visual Division, [retrieved in 2002], no URL available, 1pg.

"Say Goodbye to Light Bulbs: New Materials Developed by Opsys", Isis Innovation News, (http // www isis innovation com/about/news/opsys-lightbulbs html), download date: Jan. 5, 2006, 3 pp.

Goosnes, Michael, "Laser Beam and Transparent Sensors", (http // atlas web cern ch/atlas/TP/NEW/HTML/tp9new/node253 html), download date: Jan. 5, 2006, 2pp.

Fleishman, Glenn, "Wireless Networks Let You Finally Cut the Cord", The Seattle Times, (http // www archives seattletimes nwsource com/cgi-bin/texis cgi/web/vortex . . . ), download date: Jan. 2, 2006, 4pp.

"Firm Develops Flexible, Transparent Displays for Military Use", Photonics Business World, (http // www photonics com/spectra/business/XQ/ASP/business 719/QX/read htm), download date: Jan. 5, 2006, 2pp.

Website, "Extending the Casino Floor", Game Cast Live, (http // www gamecastlive com/presentation/toronto_files/slide0012 htm), download date: Jun. 6, 2001, 10pp.

Davy, K., "Big Ichigekil Pachi-Slot Taikouryko Universal Museum - Reader Review" Copyright 1995-2001, Game FAQs, 2pp.

"Station Announces Formation of GameCase Live, LLC and Release of Remote Play eSlots for In-Room Gaming Application", PR Newswire, Jun. 6, 2001, Section: Financial News, 2pp.

Newsletter Sent via email: "The CR Newsletter", do_not_email @ crnewsletter com, sent Jan. 20, 1998.
Website, "Insuring Your Online Wagers", WINNERonline com Staff, (http // www winneronline com/articles/November2001/gambling_ins . . . ), download date: Nov. 28, 2001, 1pg.
Website, "Online Blackjack, Poker, Slots and More - Casino Vegas Royale", (htt // www casinovegasroyal com/insurance shtml), Copyright 2002, 1pg.
Website: "Who says You Can't Win From Losing? 49er and Three Diamonds Casino Offer 'Free Insurance' for Online Play in July", (http // www smartplayers net/insurance htm), Jun. 14, 2003, 1 pg.
Grochowski, John, "Computers Held Learn Winning Strategy", Chicago Sun-Times, Jun. 30, 1995, Section Weekend Plus, Gaming, p. 13, NC, 2pp.
Pledger, Marcia, "Going for the Gold at Slot Tournaments", Las Vegas Review-Journal Dec. 24, 1995, p. 5.L., 4pp.
Hawley, David, "Those One-Armed Bandits; Slot Machine Tournaments Lure Throngs to Midwest Casinos", The Houston Chronicle, Apr. 9, 1996, Section: Houston, p. 3.
Grochowski, John, "Slot Tourney Prospers Under Indiana Rules", Chicago Sun-Times, Apr. 6, 1997, Section: SHO, Casinos, p. 15, NC., 1pg.
Email: "We Have Added a New 'Auto-Spin' Feature . . . ", slotmachine @ searchout com, (http // www searchout com), Sep. 17, 1999, 1pg.
Website: "Bingo - Network Gaming International:", Network Gaming International Corp., (http // network-bingo com/bingo htm), download date: Nov. 13, 1996, 5pp.
"Super Double Jackpot" PC Software from 'SafeGuard Information Services', Oct. 14, 2002, 5pp.
Brochure: "Oasis Electronic Pull-Tab Network", Copyright 1993 Infinational Technologies, Inc., 9pp.
Office Action for U.S. Appl. No. 10/635,986, dated Feb. 29, 2008, 9pp.
Office Action for U.S. Appl. No. 11/424,006, dated Apr. 14, 2008, 5pp.
Office Action for U.S. Appl. No. 11/424,009, dated Jan. 16, 2008, 9pp.
Office Action for U.S. Appl. No. 09/879,299, dated Aug. 29, 2001, 6pp.
Interview Summary for U.S. Appl. No. 09/879,299, dated Sep. 11, 2001, 2pp.
Interview Summary for U.S. Appl. No. 09/879,299, dated Sep. 14, 2001, 3pp.
Office Action for U.S. Appl. No. 09/879,299, dated Apr. 23, 2002, 5pp.
Notice of Allowability U.S. Appl. No. 09/879,299, dated Jun. 13, 2002, 3pp.
Notice of Allowability for U.S. Appl. No. 09/879,299, dated Aug. 14, 2002.
Notice of Allowability for U.S. Appl. No. 09/879,299, dated Apr. 23, 2003, 2pp.
Office Action for U.S. Appl. No. 10/159,722, dated Sep. 24, 2002, 5pp.
Interview Summary for U.S. Appl. No. 10/159,722, dated Nov. 20, 2002, 3pp.
Interview Summary for U.S. Appl. No. 10/159,722, dated Nov. 4, 2002, 4pp.
Interview Summary for U.S. Appl. No. 10/159,722, dated Dec. 4, 2002, 3pp.
Office Action for U.S. Appl. No. 10/159,722, dated Feb. 24, 2004, 8pp.
Interview Summary for U.S. Appl. No. 10/159,722, dated May 6, 2004, 3pp.
Notice of Allowability for U.S. Appl. No. 10/159,722, dated Nov. 30, 2004, 4pp.
Notice of Allowability for U.S. Appl. No. 10/159,722, dated Jul. 28, 2005, 4pp.
Office Action for U.S. Appl. No. 11/217,588, dated Jan. 12, 2007, 14pp.
Office Action for U.S. Appl. No. 11/217,588, dated Sep. 26, 2007, 11pp.
Notice of Allowability for U.S. Appl. No. 11/217,588, dated Nov. 19, 2007, 2pp.
Notice of Allowability for U.S. Appl. No. 11/217,588, dated Jun. 13, 2008, 2pp.
Office Action for U.S. Appl. No. 08/774,487, dated Dec. 22, 1998, 6pp.
Notice of Allowability for U.S. Appl. No. 08/774,487, dated Jul. 19, 1999, 1pg.
Office Action for U.S. Appl. No. 09/437,204, dated Jun. 21, 2000, 8pp.
Notice of Allowability for U.S. Appl. No. 09/437,204, dated Jan. 29, 2001, 3pp.
Office Action for U.S. Appl. No. 10/681,075, dated Oct. 13, 2004, 17pp.
Interview Summary for U.S. Appl. No. 10/681,075, dated Dec. 27, 2005, 7pp.
Office Action for U.S. Appl. No. 10/681,075, dated Apr. 28, 2006, 13pp.
Office Action for U.S. Appl. No. 10/681,075, dated Oct. 27, 2006, 15pp.
Office Action for U.S. Appl. No. 10/681,075, dated Oct. 30, 2007, 13pp.
Office Action for U.S. Appl. No. 10/681,075, dated May 15, 2007, 15pp.
Advisory Action for U.S. Appl. No. 10/681,075, dated Aug. 24, 2007, 2pp.
Office Action for U.S. Appl. No. 10/681,520, dated Oct. 9, 2007, 10pp.
Office Action for U.S. Appl. No. 11/423,037, dated Jan. 25, 2008, 6pp.
Office Action for U.S. Appl. No. 11/423,037, dated Jun. 20, 2007, 8pp.
Office Action for U.S. Appl. No. 11/423,043, dated May 28, 2008, 6pp.
Office Action for U.S. Appl. No. 10/331,438, dated May 3, 2006, 6pp.
Office Action for U.S. Appl. No. 10/331,438, dated Jun. 20, 2006, 6pp.
Office Action for U.S. Appl. No. 10/331,438, dated Apr. 4, 2007, 14pp.
Office Action for U.S. Appl. No. 10/331,438, dated Dec. 21, 2007, 13pp.
Office Action for U.S. Appl. No. 11/462,756, dated Mar. 25, 2008, 6pp.
Office Action for U.S. Appl. No. 11/462,850, dated Mar. 14, 2008, 5pp.
Office Action for U.S. Appl. No. 11/428,599, dated Apr. 17, 2007, 4pp.
Office Action for U.S. Appl. No. 11/428,599, dated Dec. 20, 2007, 7pp.
Office Action for U.S. Appl. No. 11/428,601, dated Apr. 20, 2007, 5pp.
Office Action for U.S. Appl. No. 11/428,601, dated Jan. 8, 2008, 5pp.
Office Action for U.S. Appl. No. 11/428,601, dated Apr. 28, 2008, 8pp.
Office Action for U.S. Appl. No. 11/456,882, dated Mar. 26, 2008, 7pp.
Office Action for U.S. Appl. No. 11/456,758, dated Jan. 12, 2008, 5pp.
Office Action for U.S. Appl. No. 11/456,726, dated Jun. 6, 2008, 7pp.
Office Action for U.S. Appl. No. 09/930,717, dated Sep. 23, 2002, 7pp.
Interview Summary for U.S. Appl. No. 09/930,717, dated Dec. 13, 2002, 2pp.
Office Action for U.S. Appl. No. 09/930,717, dated Jul. 16, 2003, 6pp.
Interview Summary for U.S. Appl. No. 09/930,717, dated Oct. 7, 2003, 2pp.
Office Action for U.S. Appl. No. 09/930,717, dated Mar. 31, 2004, 8pp.
Interview Summary for U.S. Appl. No. 09/930,717, dated Aug. 2, 2004, 4pp.
Office Action for U.S. Appl. No. 09/930,717, dated Sep. 23, 2004, 5pp.

Notice of Allowability for U.S. Appl. No. 09/930,717, dated Mar. 18, 2005, 6pp.
Office Action for U.S. Appl. No. 11/199,405, dated Apr. 21, 2006, 11pp.
Interview Summary for U.S. Appl. No. 11/199,405, dated Aug. 10, 2006, 3pp.
Office Action for U.S. Appl. No. 11/199,405, dated Jan. 26, 2007, 11pp.
Office Action for U.S. Appl. No. 11/199,405, dated Jul. 5, 2007, 11pp.
Office Action for U.S. Appl. No. 11/199,405, dated Apr. 17, 2008, 7pp.
Office Action for U.S. Appl. No. 08/880,838, Oct. 6, 1999, 4pp.
Notice of Allowance for U.S. Appl. No. 08/880,838, dated Dec. 6, 1999, 1pg.
Office Action for U.S. Appl. No. 09/518,760, dated May 9, 2001, 7pp.
Notice of Allowability for U.S. Appl. No. 09/518,760, dated Aug. 10, 2001, 1pg.
Office Action for U.S. Appl. No. 10/420,066, dated Sep. 22, 2006, 11pp.
Office Action for U.S. Appl. No. 10/420,066, dated Jul. 13, 2007, 12pp.
Office Action for U.S. Appl. No. 10/001,089, dated Sep. 12, 2003, 9pp.
Office Action for U.S. Appl. No. 10/001,089, dated Apr. 6, 2004, 11pp.
Interview Summary for U.S. Appl. No. 10/001,089, dated Aug. 12, 2004, 4pp.
Office Action for U.S. Appl. No. 10/001,089, dated Jul. 11, 2005, 23pp.
Notice of Allowability for U.S. Appl. No. 10/001,089, dated Jun. 28, 2006, 8pp.
Office Action for U.S. Appl. No. 10/985,131, dated Nov. 3, 2005, 4pp.
Advisory Action for U.S. Appl. No. 10/681,075, dated Aug. 24, 2007, 2pp.
"Affidavit Under 37CFR 1.131", for U.S. Appl. No. 10/134,007, entitled "Continuous Play Slot Machine and Retrofit Kit", filed Jan. 4, 2005 in the name of Charles Murphy, 14pp.
U.S. Appl. No. 08/766,576, "Secure Improved Remote Gaming System", filed Dec. 6, 1996.
U.S. Appl. No. 09/218,258, entitled "System and Method for Automatically Initiating Game Play on an Electronic Gaming Device", filed Dec. 6, 1996.
Pending U.S. Patent Application entitled: "Methods and Apparatus for Providing Communications Services at a Gaming Machine", Walker et al., U.S. Appl. No. 10/420,118, Filed Apr. 21, 2003.
The International Search Report for PCT Application No. PCT/US03/24789, dated Jan. 13, 2004, 7pp.
The International Search Report for PCT Application No. PCT/US03/08540, dated Jun. 19, 2003, 5pp.
Written Opinion for PCT Application No. PCT/US03/05840, dated Jan. 27, 2004, 5pp.
International Preliminary Examination Report for PCT Application No. PCT/US03/08540, dated Sep. 13, 2004, 4pp.
Written Opinion for PCT Application No. PCT/US03/33313, dated Nov. 8, 2005, 8pp.
The International Search Report for PCT Application No. PCT/US04/33313, dated, Nov. 8, 2005, 4pp.
Supplementary European Search Report for EP 02 75 2846, dated Aug. 24, 2006, 2pp.
The International Search Report for PCT Application No. PCT/US02/26202, dated Oct. 2, 2002, 7pp.
Written Opinion for PCT Application No. PCT/US02/26202, dated Apr. 29, 2003, 6pp.
International Preliminary Examination Report for Application No. PCT/US02/26202, dated Apr. 14, 2004, 4pp.
The International Search Report for PCT Application No. PCT/US03/12271, dated Sep. 15, 2003, 8pp.
The International Search Report for PCT Application No. PCT/US02/14231, dated Jul. 8, 2002, 7pp.
Written Opinion for PCT Application No. PCT/US02/14231, Apr. 7, 2003, 4pp.
International Preliminary Examination Report for PCT Application No. PCT/US02/14231, dated Dec. 1, 2003, 4pp.
The International Search Report for PCT Application No. PCT/US03/24789, dated Jan. 13, 2004, 7pp.
The International Search Report for PCT Application No. PCT/US06/60845, dated Jan. 18, 2008, 5pp.
Written Opinion of the International Searching Authority for PCT Application No. PCT/US06/60845, dated Jan. 18, 2008, 3pp.

444

| NAME 4440 | SOCIAL SECURITY NUMBER 4441 | PLAYER ID 4442 | ADDRESS 4443 | PHONE NUMBER 4444 | CREDIT CARD NUMBER 4445 | CREDIT BALANCE 4446 | COMP. POINTS 4447 | HOTEL ROOM 4448 | PLAYER STATUS RATING 4449 |
|---|---|---|---|---|---|---|---|---|---|
| RON JONES | 111-11-1111 | P111111 | ANYWHERE, USA | 222-333-4444 | 1111-1111-1111-1111 | 150 | 900 | 239 | BRONZE |
| LISA WILSON | 222-22-2222 | P222222 | SOMEPLACE, USA | 333-444-5555 | 2222-2222-2222-2222 | 34 | 25000 | 310 | GOLD |
| AMY SMITH | 333-33-3333 | P123456 | ANYPLACE, USA | 444-555-6666 | 3333-3333-3333-3333 | 0 | 2000 | 925 | SILVER |

FIG. 4

446

| PLAYER ID 4460 | MACHINE ID NUMBER 4461 | LOCK START TIME 4462 | LOCK END TIME 4463 | MAXIMUM NUMBER OF PULLS 4464 | LIMITING CREDIT BALANCE 4465 | LIMITED MAXIMUM PAYOUT 4466 | BET PER PULL 4467 | TIME BETWEEN PULLS 4468 | COMM. DEVICE NUMBER 4469 |
|---|---|---|---|---|---|---|---|---|---|
| P444444 | M1111 | 4:54PM | 5:54PM | 500 | 1000 | 200 | $0.25 | 5 SECONDS | C111111 |
| P555555 | M2222 | 12:00PM | 12:10PM | 50 | 0 | 10000 | $5 | .5 SECONDS | C222222 |
| P666666 | M3333 | 8:30AM | 10:30AM | 10000 | 25; 500 | 25 | $1 | .2 SECONDS | C333333 |

FIG. 5

448

| COMMUNICATION DEVICE NUMBER 4480 | COMMUNICATOR IDENTIFIER 4481 | PLAYER ID 4482 | COMMUNICATION TIME OUT 4483 | COMMUNICATION TIME IN 4484 |
|---|---|---|---|---|
| C444444 | 123-456-7890 | P112233 | 8:27 PM | 10:02 PM |
| C555555 | 111-333-5555 | P223344 | 8:40 PM | 9:00 PM |
| C666666 | 27.234.1.10 | P334455 | 10:50 PM | |

FIG. 6

449

| MACHINE ID NUMBER 4491 | MACHINE TYPE 4492 | MACHINE DENOMINATIONS 4493 | MAXIMUM COINS 4494 | PAYOUT STRUCTURE 4495 | REEL POSITIONS 4496 | PAYOUT (COINS) 4497 |
|---|---|---|---|---|---|---|
| M1234 | FRUIT | $1 | 5 | CHERRY-CHERRY-BAR: 10<br>BAR-ORANGE-ORANGE: 10... | LEMON-LEMON-CHERRY | 2 |
| M1122 | JACKS OR BETTER | $0.05 | 90 | ROYAL FLUSH: 800<br>STRAIGHT FLUSH: 50... | A(S) K(S) 10(h) 10(D) 3(C) | 0 |
| M2345 | DUECES WILD | $0.25 | 4 | ROYAL FLUSH: 4000<br>FOUR DUECES: 1000... | 2 2 2 3(H) 5(C) | 25 |

FIG. 7

1000

| OUTCOME 1440 | RANDOM NUMBER 1452 |
|---|---|
| NONWINNING COMBINATION | 1-8570 |
| CHERRY/ANY/ANY | 8571-9250 |
| ANY/ANY/CHERRY | 9251-9930 |
| CHERRY/CHERRY/ANY | 9931-10130 |
| ANY/CHERRY/CHERRY | 10131-10330 |
| CHERRY/ANY/CHERRY | 10331-10398 |
| CHERRY/CHERRY/CHERRY | 10399-10418 |
| BAR/ORANGE/ORANGE | 10419-10460 |
| ORANGE/ORANGE/BAR | 10461-10466 |
| ORANGE/ORANGE/ORANGE | 10467-10508 |
| BAR/PLUM/PLUM | 10509-10528 |
| PLUM/PLUM/BAR | 10529-10533 |
| PLUM/PLUM/PLUM | 10534-10583 |
| BAR/BELL/BELL | 10584-10587 |
| BELL/BELL/BAR | 10588-10607 |
| BELL/BELL/BELL | 10608-10627 |
| BAR/BAR/BAR | 10628-10647 |
| 7/7/7 | 10648 |

FIG. 10

1200

| SESSION IDENTIFICATION NUMBER 1210 | REPRESENTATIVE NAME 1220 | REPRESENTATIVE IDENTIFICATION NUMBER 1230 | PLAYER NAME 1240 | CONTRACT IDENTIFICATION NUMBER 1250 | AMOUNT OF MONEY BEING CHECKED OUT 1260 | TIME AND DATE OF CHECKOUT 1270 | AMOUNT OF MONEY BEING RETURNED 1280 | TIME AND DATE OF RETURN 1290 |
|---|---|---|---|---|---|---|---|---|
| S111111 | WILLIAM BROWN | R1234 | ROBERT JONES | C111222 | $1000 | 2:44PM 1/7/2005 | $490 | 4:02PM 1/7/2005 |
| S222222 | LINDA SMITH | R5678 | JOHN WRIGHT | C987654 | $500 | 3:10PM 1/7/2005 | $780 | 5:14PM 1/7/2005 |
| S333333 | WILLIAM BROWN | R1234 | EMILY THOMAS | C221122 | $2500 | 4:20PM 1/7/2005 | | |
| S444444 | | | | | | | | |
| | | | | | | | | |

FIG. 12

SYSTEM AND METHOD FOR REMOTE AUTOMATED PLAY OF A GAMING DEVICE

PRIORITY CLAIM TO CO-PENDING APPLICATIONS

This application: is a continuation of U.S. patent application Ser. No. 10/635,986, filed Aug. 7, 2003, which;

(A) is a continuation-in-part of U.S. patent application Ser. No. 10/159,722, entitled "SYSTEM AND METHOD FOR AUTOMATED PLAY OF MULTIPLE GAMING DEVICES," filed on May 30, 2002 and issued on Nov. 29, 2005, as U.S. Pat. No. 6,969,317; which is a continuation of U.S. patent application Ser. No. 09/879,299, entitled "SYSTEM AND METHOD FOR AUTOMATED PLAY OF MULTIPLE GAMING DEVICES," filed on Jun. 12, 2001; which is a continuation-in-part of U.S. patent application Ser. No. 09/437,204, entitled "AUTOMATED PLAY GAMING DEVICE," filed on Nov. 9, 1999, and issued on Jun. 12, 2001 and issued on Oct. 21, 2003, as U.S. Pat. No. 6,634,942; as U.S. Pat. No. 6,244,957; which is a continuation of U.S. patent application Ser. No. 08/774,487, "AUTOMATED PLAY GAMING DEVICE," filed on Dec. 30, 1996, and issued on Jan. 11, 2000, as U.S. Pat. No. 6,012,983; and also (B) claims the benefit of priority of U.S. Provisional Patent Application No. 60/401,853, "SYSTEM AND METHOD FOR REMOTE AUTOMATED PLAY OF GAMING DEVICES," filed Aug. 7, 2002.

Each of the above applications is incorporated herein by reference in its entirety.

BACKGROUND OF THE INVENTION

1. Field of the Invention

The present invention relates generally to a method and apparatus for facilitating automated play of a gaming device (or multiple gaming devices), such as a slot machine.

2. Description of Related Art

There are numerous types of gaming devices in use today. Most of these gaming devices, such as slot machines, video blackjack machines, video poker devices, or the like, require the player of the device to be physically present during game play. Specifically, the player must be present to continuously feed money into the gaming device, initiate each play of the device, and receive any payout from the device. The requirement of a physical presence is not only a hardship on a player, as will be further described below, but also results in substantial down-time to the casino owner of the gaming device. While casinos typically have a large capital investment in gaming devices, and particularly slot machines, these devices go unused a large portion of the time. For example, late at night, between successive players, and during inclement weather, are times when such devices may go largely unused.

For a player, a constant presence at a gaming device may comprise both a physical and emotional hardship. For example, a player may wish to leave the gaming device momentarily to have dinner or take a short rest before returning to the machine. In other instances, the player may wish to leave for an extended period to attend a show, play a round of golf, or the like.

Despite wanting to leave the gaming device, the player often will desire to continue playing. Because a players stay at a casino is limited, a player will often want to maximize the playing time, thereby increasing the chances of winning. For instance, a player may attempt to play at multiple gaming devices at the same time. Moreover, a player often desires to continue playing the same gaming device or devices because the player believes that the chance of winning at a particular device or devices is great.

In response to a desire to physically leave a gaming device yet continue playing it, players have been known to manually "lock-up" a device. Such manual locking-up of a device has typically been achieved by placing a "reserved" sign on the device or, in the case of slot machines, placing a change cup on the pull handle. In theory, by manually locking-up a device, a player prevents others from playing that device until the player returns to resume play.

In practice, however, manually locking-up a gaming device has several disadvantages. Manually locking-up a device is ineffectual as there can be no guarantee that other players will respect the indication that the device is locked-up. Despite the "reserved" sign or the change cup on the handle, another player may still operate the manually locked-up device. During such an apparent lock-up, the device is really reserved, not physically secured. Even if no other player begins play on the locked-up device, the time away from the device is lost; not only has the player lost opportunities to hit a jackpot, but also the owner of the device has lost significant revenue by allowing the device to go unused. Thus, there is a need for a method and system for automated play of a gaming device (or multiple gaming devices) in a continuous gambling mode while the player is away from the device(s).

The game of Keno resembles automated play. A game of Keno consists of matching a series of player-selected numbers against a series of numbers drawn by the Keno system. Once the player has selected the series of numbers, the player selects a certain number of games for which those numbers are valid. Thus, by selecting several games, the player may bet on future games without further interaction with the system.

Despite proceeding without interaction between the player and the Keno system, there is neither true automated play nor device lock-up in Keno. The numbers are drawn by the system and broadcast or transmitted to a number of screens throughout an establishment, such as a casino. An unlimited number of players can attempt to match the numbers drawn. Thus, each screen displaying the numbers drawn by the system need not be locked-up. Furthermore, the Keno games continue indefinitely, without regard to either (i) a particular player s status, (ii) a particular player's participation, or (iii) the outcome of a prior game. Thus, while the number drawings in Keno may occur in a continuous manner, there is no automated play for a particular customer.

BRIEF DESCRIPTION OF THE DRAWINGS

FIG. 4 is a schematic view of the player database of FIG. 3 in accordance with one or more embodiments of the present invention;

FIG. 5 is a schematic view of the automated session database of FIG. 3 in accordance with one or more embodiments of the present invention;

FIG. 6 is a schematic view of the communication device database of FIG. 3 in accordance with one or more embodiments of the present invention;

FIG. 7 is a schematic view of the slot machine database of FIG. 3 in accordance with one or more embodiments of the present invention;

FIG. 10 is an exemplary table for matching numbers generated by a random number generator in accordance with one or more embodiments of the present invention;

FIG. 12 is an exemplary log in accordance with one embodiment of the present invention.

DETAILED DESCRIPTION OF PREFERRED EMBODIMENTS

Figure 1:
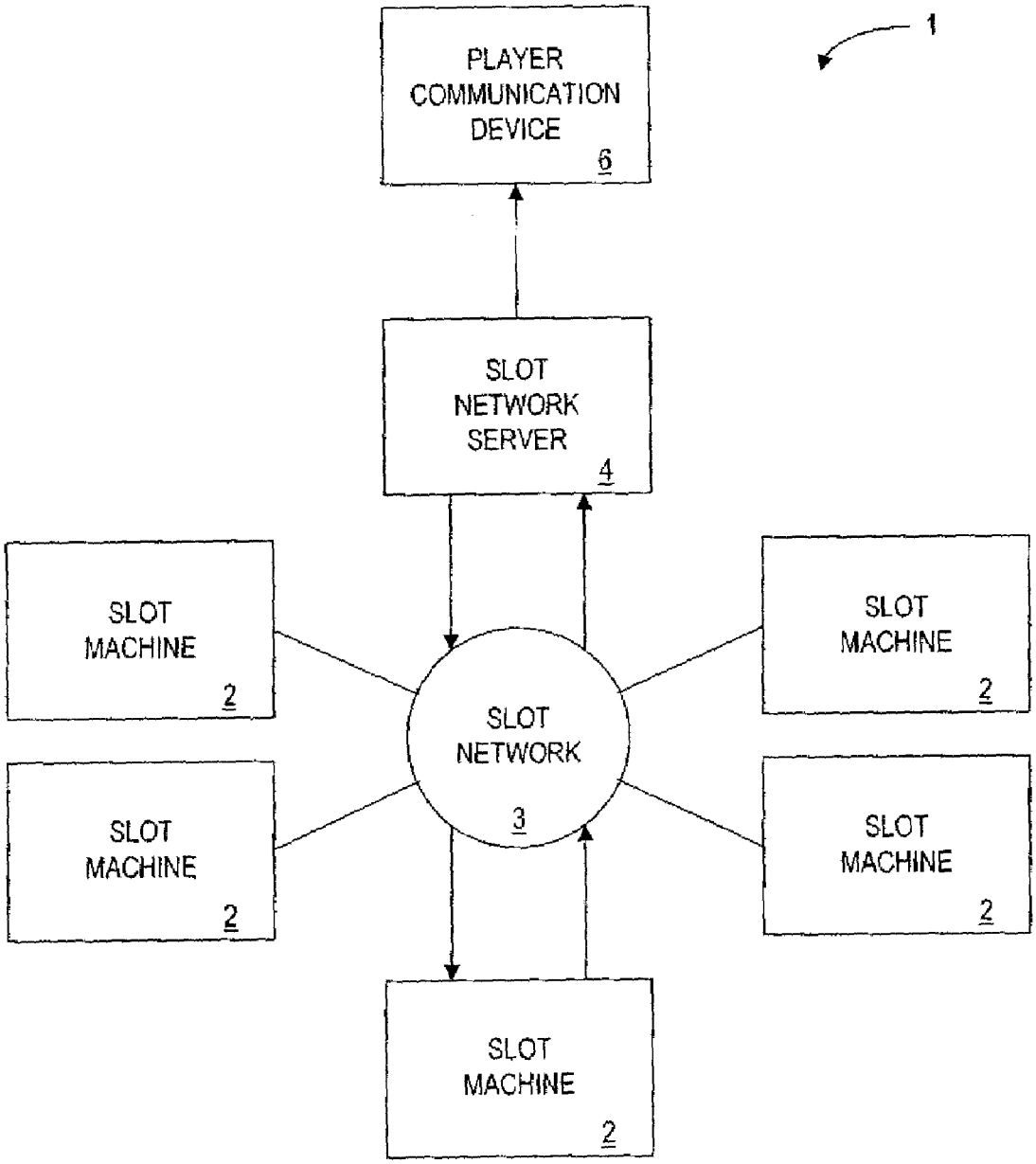
FIG. 1 is an overall schematic view of a system according to one embodiment of the present invention, including a slot machine, a slot network server, and a player communication device.

Various embodiments of the present invention provide a method and apparatus for automated play which permits a casino to recognize substantially increased play time, and hence revenue, from a gaming device. At the same time, these various embodiments satisfy a player's emotional desire to maximize his playing time on a gaming device or devices, while accommodating the physical need to at times be away from the machines.

Various embodiments of the present invention include a gaming device operable to receive a limiting criterion of play, initiate automated play of a gaming device, and terminate automated play of the gaming device upon occurrence of the limiting criterion. In another embodiment of the present invention, the automated play of the gaming device includes repetitive play of the device.

A method according to one or more embodiments of the present invention provides for initiating an automated session, in which the automated session comprises a plurality of games, and receiving a first signal including a video representation of the automated session. The first signal may be received, for example, from a camera operable to view at least one gaming device. The method also includes transmitting a second signal including the video representation of the automated session to a player communication device. In one embodiment, the second signal is transmitted in response to receiving a request for the video representation from a player.

A method according to one or more embodiments of the present invention provides for: receiving a request for an automated session, in which the automated session comprises a plurality of games; initiating a first game of the automated session, the first game corresponding to a first gaming device; and initiating a second game of the automated session, the second game corresponding to a second gaming device.

In many instances, the limiting criteria will be the use of the moneys initially authorized for play—i.e., a gaming device, operating in the automated play mode, runs out of money. The present invention further provides a method and apparatus for notifying a player when available credit is running low, permitting a player to visit and place more money in a machine, or to remotely authorize further funds for continued play.

A method according to other various embodiments of the present invention includes the steps of communicating a player parameter selection to a gaming device and initiating automated play of the gaming device. In such embodiments, automated play of the gaming device occurs when the gaming device is unattended by a player.

According to other various embodiments, the method includes the steps of receiving a play option and automatically playing a gaming device according to the play option.

The present invention also includes a gaming device which includes a memory device having a player parameter selection stored therein and a processor in communication with the memory device. The processor is configured to initiate automated play of the gaming device until occurrence of a limiting criterion of play.

Various embodiments of the present invention provide for a slot machine operable to: receive a command to start a game, in which the command is a signal that does not correspond to a manually initiated play; play a game in response to receiving the command; and transmit outcome data corresponding to the game.

Other various embodiments of the present invention receive a request for an automated session, in which the automated session comprises a plurality of games; initiate a first game of the automated session, the first game corresponding to a first gaming device; and initiate a second game of the automated session, the second game corresponding to a second gaming device.

Various embodiments of the present invention provide for receiving outcome data from a plurality of gaming devices and determining which outcomes to include in the player's automated play session based on the player's selection parameters for the automated play session.

Various embodiments of the present invention provide for allowing a player of an automated play session to switch automated play from one gaming device to another during an automated play session. Other various embodiments provide for initiating a game of an automated session at a gaming device that is different from the gaming device into which the player entered an amount of funds for the automated play session.

Various embodiments of the present invention provide for determining an outcome of an automated play session that requires a decision by the player in order to determine a further outcome or a payout and then holding the outcome for a later decision by the player.

Various embodiments of the present invention provide for determining a player associated with an automated play session, selecting a gaming device, and providing the player with an offer of a reward in exchange for the player receiving a payout of the automated play session at the selected gaming device.

Various embodiments of the present invention provide for determining a player and providing to the player an offer of a reward in exchange for the player playing an automated play session.

Various embodiments of the present invention provide for allowing an automated play session to be based on at least one outcome of manual play at a gaming device. A method is thus provided for receiving first outcome data associated with a game initiated by a first player at a gaming device, determining an automated play session associated with a second player, and determining second outcome data for the automated play session based on the first outcome data and a session parameter of the automated play session.

Various embodiments of the present invention provide for maintaining an audit trail for a gaming device and the outcomes of a gaming device whereby the gaming device may be used to provide games to an automated play session of a remote player (or players) while a player at the gaming device may also play the gaming device.

The present invention is directed generally to automated play of a gaming device or devices. In various embodiments, a player enters player identifying information and player parameter selections at a gaming device. The gaming device stores the player parameter selections and proceeds to initiate automated play of the gaming device or of multiple gaming devices.

Such automated play may occur while the gaming device is unattended by the player. In various embodiments, the gaming device is locked-up such that no other player may use the gaming device during automated play. In various other embodiments, the gaming device is not locked-up, allowing a player to play the gaming device even while the gaming device is involved in automated play for a remote player. In this manner, the casino may benefit from increased usage of the gaming device.

As noted above, one or more gaming devices used for automated play may be unavailable for manual play (for at least some period of time). For example, a gaming device may be locked-up or may otherwise be configured (or be configurable) so as to prevent manual play (at least temporarily). According to some embodiments, one or more gaming devices used for automated play may be physically inaccessible to a player (or to any player). For example, a plurality of slot machines may be stored in a location (e.g., a warehouse or room) that players are not permitted to enter.

Remote communications with the player permit the player engaged in automated play both to enjoy the ongoing play, and to alter any pre-established, limiting criteria, for example relating to funding, by making appropriate adjustments during the course of automated play. In various embodiments of the present invention, such adjustments may be made at a gaming device. In other various embodiments, such adjustments may be made via a communication device. Some limitations may also be altered remotely, through a telephone call or appropriate communication to casino personnel. The automated play session ends upon occurrence of a limiting criterion or upon the manual termination of the automated play session by the player.

Certain preferred embodiments of the present invention will now be described in greater detail with reference to the drawings. Although the embodiments discussed herein are directed to reel slot machines, it should be understood that the present invention is equally applicable to other gaming devices, such as video poker machines, video blackjack machines, or the like.

With reference to FIG. 1, a system 1 according to one embodiment of the present invention is shown. In general, the system 1 comprises multiple slot machines 2, a slot network server 4, and a player communication device 6, such as a pager, handheld display device, set-top display device, or cellular telephone. In the present embodiment, each slot machine 2, which is uniquely identified by a machine identification (ID) number, communicates with the slot network server 4 via a slot network 3. The slot network 3 is preferably a conventional local area network controlled by the server 4. It is to be understood, however, that other arrangements in which the slot machines 2 communicate with the server 4 are within the scope of the present invention.

As will be described in greater detail below, the slot machine 2 communicates player identifying information and player parameter selections to the slot network server 4. The slot network server 4, in turn, may communicate locking data to the slot machine 2. Additionally, the slot machine 2 generates machine messages and outcome data. The slot machine 2 communicates the machine messages and outcome data to the slot network server 4, which, in turn, communicates the information to the player communication device (or communication devices) 6. Communication device 6, for example, a pager including a display, provides sufficient information to permit the player to follow and enjoy the play, and in some cases to authorize necessary or desired changes in the play.

Figure 2:
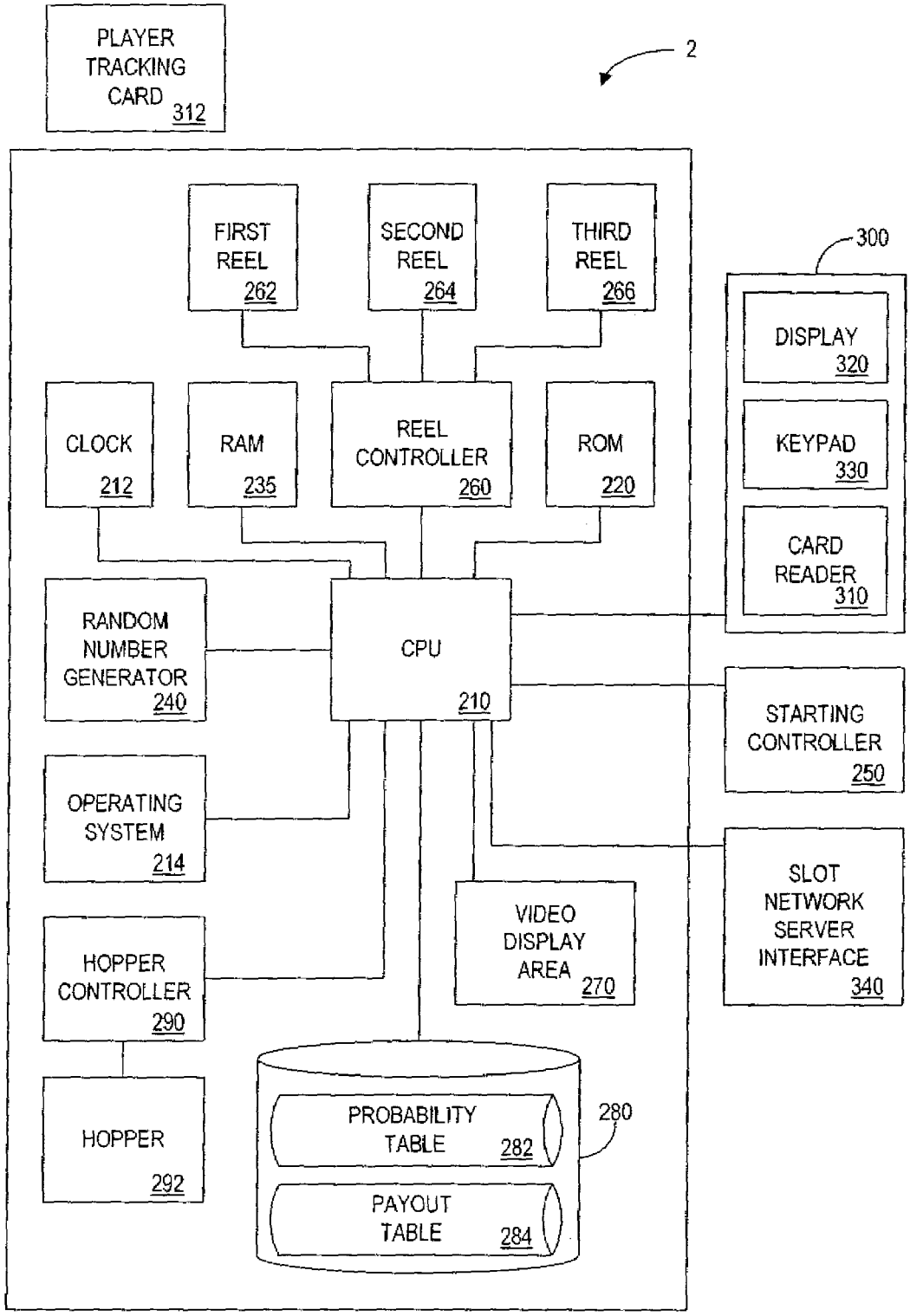
FIG. 2 is a schematic view of the slot machine of FIG. 1 in accordance with one or more embodiments of the present invention.

With reference to FIG. 2, the slot machine 2 will now be described in greater detail. The slot machine 2 contains a Central Processing Unit (CPU) 210, a clock 212, and an operating system 214 (typically stored in memory as software). The CPU 210 executes instructions of a program stored in Read Only Memory (ROM) 220 for playing the slot machine 2. The Random Access Memory (RAM) 230 temporarily stores information passed to it by the CPU 210 during play. Also in communication with the CPU 210 is a Random Number Generator (RNG) 240.

With respect to gaming operations, the slot machine 2 may operate in a conventional manner. The player may start the machine 2 by inserting a coin, or using electronic credit, and pressing the starting controller 250. Under control of a program stored, for example in a storage device 280 or ROM 220, the CPU 210 initiates the RNG 240 to generate a random number. Alternatively, the CPU 210 may be controlled by, or respond to, for example, a stored program or a signal from the slot network server 4. In such a situation, the CPU 210 would initiate the RNG 240 to generate a random number at a time other than in response to an attending player pressing the starting controller 250.

The CPU 210 looks up the generated random number in a stored probability table 282 and finds the corresponding outcome. Based on the identified outcome, the CPU 210 locates the appropriate payout in a stored payout table 284. The CPU 210 also directs a reel controller 260 to spin reels 262, 264, 266 and to stop them at a point when they display a combination of symbols corresponding to the selected payout and/or identified outcome. When the player wins, the machine stores the credits in RAM 230 and displays them in video display area 270.

In alternative embodiments, the slot machine contains two CPUs. A first of the CPUs is dedicated to executing instructions for a program to allow a person physically present at the slot machine to play the slot machine. A second of the CPUs is dedicated to executing instructions for a program to allow a person remote from the slot machine to play the slot machine. In these embodiments, both a person physically present and a remote person can play the same slot machine. However, each will receive the benefit of outcomes generated on different processors. Casino regulators may prefer such an arrangement as then there is no question as to whether an outcome generated at a gaming device should benefit a person physically present at the slot machine, or a remote player. Of course, two remote players could play the slot machine using a respective CPU in a slot machine containing multiple CPUs.

A hopper controller 290 is connected to a hopper 292 for dispensing coins. When the player requests to cash out by pushing a button on the slot machine 2, the CPU 210 checks the RAM 230 to see if the player has any credit and, if so, signals the hopper controller 290 to release an appropriate number of coins into a payout tray (not shown).

In alternative embodiments, the slot machine 2 does not include the reel controller 260 and reels 262, 264 266. Instead, a video display area 270 graphically displays representations of objects contained in the selected game, such as graphical reels or playing cards. These representations are preferably animated to display playing of the selected game.

Also in communication with the CPU 210 is a player tracking device 300. The tracking device 300 may comprise a card reader 310 for reading player identification information stored on, or otherwise indicated by, player tracking card 312. As used herein, the term player identifying information denotes any information or compilation of information that uniquely identifies a player. In the present embodiment, the identifying information is a player identification (ID) number and player name. Although not so limited, the player tracking card 312 of the present embodiment stores the player ID and player name on a magnetic strip located thereon. Such a magnetic strip and device to read the information stored on the magnetic strip are well-known.

The player tracking device 300 also includes a display 320, having a touch screen, or a keypad 330. In operation, as discussed below, the slot machine 2 may display a message prompting the player to enter player parameter selections. In the present embodiment, a player enters the player parameter selections via the display 320 which includes a touch screen. In an alternative embodiment, the player enters the player parameter selections via a keypad 330, which is part of the tracking device 300 and, therefore, in communication with the CPU 210.

Also connected to the CPU 210 is a slot network server interface 340. The network server interface 340 provides a communication path between the slot machine 2, the slot network 3, and the slot network server 4. Thus, as discussed in greater detail below, information may be communicated among the player tracking card 312, player tracking device 300, slot machine 2, and slot network server 4.

In alternative embodiments, the slot machine 2 may contain the communication device 6, which may be detached from the slot machine 2 for remote play The player may be required to swipe a credit card, provide a credit card number, or to put up a deposit before detaching the communication device 6.

In many embodiments, the construction and operation of the slot machine 2 may be simplified. For example, a slot machine supporting remote play may be simpler than a counterpart on a casino floor because the slot machine supporting remote play need not necessarily interact directly with a player. A slot machine supporting remote play may, in some embodiments, be without lights, graphics, and sounds meant to attract players on the casino floor. The slot machine may also lack coin handling abilities, touch screens, display screens, user interfaces such as buttons and handles, and large outer casings. A slot machine supporting remote play may even lack means for displaying outcomes, such means including reels, video displays, bonus areas, etc.

In one embodiment, a simplified slot machine consists of only a CPU, a slot network interface, and supporting hardware. Supporting hardware might include power supplies, heat sinks, motherboards, a clock, and a casing for enclosing one or more of the other hardware components.

In some embodiments, multiple slot machines, or multiple components of separate slot machines, may be placed within the same outer casing. For example, a single metal enclosure surrounds three sets of reels, three CPUs, and so on. A particular CPU may receive instructions from the slot network server to generate outcomes in accordance with instructions provided by a player. The CPU may then generate such outcomes, and communicate the outcomes back to the slot network server (e.g., for transmission to the player communication device). The CPU may actually be a dedicated integrated circuit, e.g. an application-specific integrated circuit (ASIC), dedicated only to generating game outcomes. The dedicated integrated circuit may also take the form of a random number generator. The random number generator may communicate random numbers to the slot network server, which may then convert the random numbers to game outcomes using a table such as that depicted in FIG. 10.

A simplified slot machine may additionally include a memory, such as a RAM, for storing instructions received from a player or from the slot network server. The instructions may indicate to the simplified slot machine how to generate outcomes for a player. The memory may also be used to track the number of credits won or lost by a player.

A simplified slot machine may include a display for displaying outcomes, but in some embodiments the display may be very rudimentary (relative to a display on a typical slot machine). For instance, the display may consist of between three and five regions, each with a ten-by-ten matrix of black and white pixels. Each region of pixels may be suitable for displaying a simple representation of common slot indicia, such as a cherry, lemon, or Jack of diamonds. The display may serve several functions. In one capacity, the display may alert a casino attendant as to the outcome generated by the machine. The display may also alert a player (e.g., a player watching from a remote location via a video camera) as to the outcome generated by the simplified slot machine.

According to various embodiments of the present invention, a display may also indicate the identity of a player on whose behalf spins are made, the number of spins that have been made for the player, the number of credits remaining for the player, and any other pertinent information. Of course, many other types of display are also possible. A display may by a liquid crystal display capable of displaying text characters. Each text character may represent a different indicium of automated play at the slot machine. For instance "c" represents cherry, "A" represents ace, and so on.

A display may also be embodied as mechanical reels, paper flaps arranged in a looped configuration with the loop perpendicular to the plane of each paper flap (a display common in bus and train stations), and so on. A display may be of any size. In one embodiment, the display is only several square centimeters, large enough for the display of text or small graphics.

A slot machine, including a simplified slot machine, may include a display of the time and date. Such a display may take the form of an analog or digital clock, as well as a calendar. The clock may be periodically synchronized with a more accurate clock, such as an atomic clock, present at the slot network server or in some other location. The clock may allow any casino attendant or player viewing the slot machine to ascertain the time at which an outcome was generated. The clock, whether or not it has a display, may also be used in the creation of the audit information. For instance, when the CPU generates an outcome, the CPU may refer to the clock to determine the time at which the outcome was generated. The time on the clock may then be recorded next to the outcome.

In one embodiment, the clock may have the capability to display times in more than one time zone, either individually or simultaneously. Furthermore, the calendar may have the capability to display the dates in more than one time zone. The slot machine may then receive information about the location of the remote player, and display the time and date suitable to the remote player's time zone. Relevant player information may include, for instance, the location of the player's residence. Player information may be received from the slot network server, or may be obtained from the player database of FIG. 4. When displaying the time and date corresponding to a remote player's location, the clock and calendar may simultaneously display the time and date at the location of the slot machine.

The slot machine may be associated with a machine identifier that identifies the machine. For example, the machine identifier may be a sequence of alphanumeric characters, such as "FRUITSLOT12345", a bar-code, a picture, a pattern of radio signals, or any other identifier. The color of a machine may also serve as the machine identifier. The machine identifier may be a permanent fixture of the machine. For instance, the machine identifier may be carved into the side of the casino casing of the machine. Alternatively, the machine identifier may be displayed on a display device of the machine.

A slot machine identifier may allow a casino attendant or a remote player to more easily locate a machine of interest. For example, suppose a casino attendant wished to view a video audit tape of a particular machine. The casino attendant would note the machine identifier and would then look for the machine with a like identifier carved on its casing. Furthermore, a remote player viewing a video feed of his slot machine can be assured by looking at the machine identifier that his outcomes are being generated consistently by the same machine.

Various types of slot machines, including a simplified slot machine, may comprise a camera. For example, the camera may be situated to film the display area of the machine. The camera may then transmit a video feed of the display area to the slot network server, which may in turn transmit the video feed to the remote player. A video feed may comprise what appears to be full motion video, one or more still images, or any other type of image.

A remote player viewing the feed from the camera may therefore watch a simplified slot machine as it generates outcomes on his behalf. The player may thereby feel confident that outcome information transmitted to the communication device does in fact correspond to outcomes generated by his simplified slot machine. Via the camera feed, for example, a remote player may view the outcomes he receives, his remaining credits, and his accumulated winnings, as displayed at the gaming device. The remote player may also view the time and date displayed on the gaming device. A remote player who sees the time and date displayed on the video feed may feel reasonably confident, for example, that he is seeing his outcomes as they are generated in real time, rather than seeing old outcomes that may have been substituted because they were losing outcomes. Even if a player is not viewing his outcomes as they are generated in real time, he can check the clock to make sure the outcomes were generated at the time for which he left instructions to generate the outcomes.

In some embodiments, a camera is not part of the slot machine. For example, the camera may not be attached to the slot machine or to the slot machine casing. The camera may instead be attached to the ceiling or to the floor of the building housing the slot machine, or to some other fixture.

In some embodiments, a camera may be mobile. For instance, the camera may be attached to a robotic arm capable of motion in one or more dimensions. The camera may additionally have the capability of pivoting or rotating along one or more axes. The camera may also have the capability of changing its focus from a proximate focal point to a distant focal point, and vice versa. Furthermore, the camera may be able to change the direction of its focus without motion of the entire camera. The ability of the camera to move or to be moved, as well as to change its focus, allows a single camera to alternately film different slot machines, or to film multiple slot machines at once. Therefore, one advantage of having a separate camera is that a casino may save on the expense of attaching a camera to each individual slot machine.

A camera may be in communication with a slot network server. Then, the slot network server may provide the camera with instructions, for example, to focus on a slot machine that is currently generating outcomes.

If a camera is focused on a large number of slot machines at once, it may be desirable for a slot machine to indicate when it is active, and for whom it is generating outcomes. In this way, a remote viewer who sees a number of slot machines via a camera feed, can discern which slot machine is his. In one embodiment, a slot machine may include a light source. The light source may be turned on when the slot machine is, for example, currently in the process of generating outcomes. The light source may be left off when the slot machine is inactive. A slot machine may possess other indicators of activity, such as a flag that is raised or lowered depending on activity, or even a text indicator displaying the words "active" or "inactive." In some embodiments, slot machines may have the capability of displaying a number of different indicators, e.g., lights of many different colors. That way, a first remote player can focus on the machine with the purple light, a second remote viewer can focus on the machine with the green light, and so on.

According to some embodiments, a camera, whether or not it is attached to the slot machine, may come under the control of a remote player. For instance, the player may communicate to the slot network server that he wants the camera on his slot machine to zoom in on the display of his outcomes. A remote player may request that a mobile camera face in the direction of his slot machine. Such communications from the player may be relayed to the camera via the slot network server. Alternatively, the communication device may relay the player's request via the slot machine, which may then relay the request to an attached camera, or to a separate camera via the casino server.

In some embodiments, multiple cameras may be available for viewing a slot machine. For instance, two cameras can be used to create a three-dimensional visual depiction of the slot machine. This is accomplished by situating the cameras so that one camera mimics the function of a left human eye, and the other camera mimics the function of a right human eye. The feeds from the cameras can then be combined using well-known techniques to produce a three-dimensional depiction. This three-dimensional representation may then be transmitted to a player's communication device.

It is foreseen that, in many embodiments, a casino will wish to pack numerous slot machines into a compact area. On a casino floor, one factor that limits the number of slot machines is the fact that people must physically sit or stand in front of the slot machines in order to play them. It may be undesirable for slot machines to be packed so tightly that people would have to stand shoulder to shoulder in order to play them. Furthermore, typical slot machines cannot be stacked on top of one another, because, in part, people cannot reach high enough to play the uppermost slot machines. These limitations, however, may not apply to some types of simplified slot machines played by remote players.

In some embodiments, the casing a slot machine is constructed so that the slot machines may be stacked on top of one another. The casing, in one embodiment, may take the form of a box, where the box contains six sides, each side having four right-angled corners, and with opposite sides being substantially parallel to each other.

In another embodiment, the casing of a slot machine is built such that the top surface of the slot machine is of a convex nature with a shape complementing its bottom surface, which is of a concave nature. In this way, when a slot machine is situated on top of a like slot machine, its concave bottom surface fits over the convex top surface of the machine below. In a related embodiment, the top surface of a slot machine is concave, and the bottom surface is convex. In still another embodiment, the top and bottom surfaces of the slot machine contain both convex and concave components, with components from the top surface complementing those of the bottom.

In one embodiment, the top surface of a first slot machine need not be complementary to its own bottom surface, but only to the bottom surface of the slot machine to be situated above. Similarly, the bottom surface of a slot machine need only be complementary to the top surface of a slot machine to be placed below.

In some embodiments, slot machines are not stacked directly on top of one another, but may be placed onto supporting structures, such as shelves.

Arranging slot machines in three dimensions (e.g., by stacking) may make it slightly more complicated to specify a slot machine's location. A slot machine's location might be specified, for example, in three coordinates corresponding to distances from a fixed reference point, such as the door of a warehouse, in three spatial dimensions. Another example of specifying a slot machine's location is to identify it as "in the third aisle, four machines down, on the second shelf."

It will be readily understood that a mobile camera might be programmed to locate any set of coordinates within a given space, such as a warehouse. Then, a slot network server need only provide coordinates to the mobile camera for the camera to be able to find the specified slot machine.

A slot machine may have a simplified casing. Slot machines on a casino floor typically have colorful and decorative casings so as to attract players. For instance, a jungle scene, or a pyramid scene might be painted onto the outer service of a slot machine. A slot machine played on behalf of a remote player may also have a decorative casing. A decorative casing may be appealing to some types of players viewing a machine (e.g., via a camera from a remote location).

Slot machines being played and/or viewed remotely need not necessarily have casings as durable as a typical slot machine on a casino floor. For example, slot machines that are played remotely need not be on a casino floor at all, and may not ever be accessible by players (or may not be accessible as frequently). If players will not be leaning on the slot machines, nor resting drinks on them, nor jerking their handles, the casings need not be designed to withstand these stresses. Accordingly, the casing on a slot machine used for an automated play session may be constructed from cardboard, paper, or any other non-durable material. Such non-durable casings may serve to vastly reduce construction costs for a slot machine.

Furthermore, the casing of a slot machine may or may not be integral to the structural integrity of the machine, and in some embodiments may serve solely as decoration. For instance, a slot machine may be constructed with all hardware anchored to the inside of a metal shell. However, surrounding the metal shell may be placed a cardboard outer surface, serving only as decoration. Alternatively, the cardboard outer surface may not provide structural integrity, but may contain information, such as the machine identifier, type of machine, and so on. Casings may also only partially surround or enclose the functional hardware of the slot machine. For example, a cardboard casing may be placed only on the front side of a slot machine. Then, from the vantage point of a camera facing the front of the slot machine, it would appear that the machine is completely surrounded.

The casing of a slot machine may further include images or other representations of buttons, handles, coin slots, coin trays, and any other desirable elements, such as those typically found on a slot machine on a casino floor. For instance, the casing of a slot machine may have a picture of a "SPIN" button painted on its surface.

Alternatively, a more realistic depiction of a spin button may be constructed by making small box out of cardboard and pasting the box onto the surface of the machine. Of course, there are many other possible ways to visually represent the elements of a slot machine to make the slot machine look more conventional on camera. In some embodiments, a slot machine uses the same casing that would appear with the slot machine on a casino floor. Therefore, for example, the casing is durable, has potentially functional buttons, etc. However, in the case of a slot machine playing on behalf of a remote player, some of the elements of the slot machine may be left intentionally without electrical or mechanical connections. Thus, for example, although a slot machine might appear realistic in every way, the "SPIN" button (and/or other types of input or output devices) would not be operable.

In one embodiment, a decorative or other casing of a slot machine would leave openings through which underlying aspects of the slot machine would be visible. For example, suppose the core hardware of a simplified slot machine comprises three reels, one or more motors for rotating the wheels, a CPU, and other supporting hardware and electronics. The hardware, save for the reels, is enclosed in a metal shell. The reels are visible to the outside. A decorative cardboard casing is added to the slot machine so as to cover the metal shell and make the slot machine more attractive. However, it may be desirable that the cardboard does not obscure the reels. Therefore, a window is left in the cardboard through which the reels may be viewed. Thus, the overlying casing obscures the metal shell, but not the reels themselves.

One further advantage of using cardboard or other decorative casings is that a cardboard shell might be easily added or removed from a machine. For instance, suppose that a warehouse contains 1000 simplified slot machines. Five hundred currently run programs to play 9/6 Jacks Or Better™ video poker. If it happens that 9/6 Jacks Or Better™ becomes very popular, the casino operator of the warehouse may wish to convert one hundred more machines to 9/6 Jacks Or Better™. To do so, the casino need now only reprogram the one hundred machines to play 9/6 Jacks Or Better™ by, for example, loading game software into a memory of the machines. The casino operator may then simply place a cardboard front end on the one hundred machines, with the front end depicting an interface to the 9/6 Jacks Or Better™ video poker game. The casino operator has thereby eliminated the need to remove one hundred machines from the warehouse and to add one hundred new ones.

In one embodiment, a slot machine may operate much more rapidly than does a typical slot machine on the floor. For instance whereas a slot machine on the casino floor may typically take several seconds to produce an outcome after the initiation of a handle pull, a slot machine may generate an outcome within small fractions of a second. By repeatedly generating outcomes quickly, a slot machine may generate, for example, ten thousand outcomes in a second. It may be advantageous for a slot machine to generate outcomes rapidly if a player is not physically present at the machine, because there is no reason to provide the drama of a delay prior to the resolution of an outcome. Therefore, outcomes may be generated more rapidly, with each outcome earning a positive expected return for the casino.

In one embodiment, slot machines may share one or more components. The sharing of components may reduce costs associated with manufacturing the same components for every slot machine. In one embodiment, a slot machine may consist only of reels, a reel controller, and a metal shell. Multiple such slot machines may be in communication with a single processor (e.g., a slot server). The processor may then generate outcomes for each of the slot machines, and each slot machine may display its outcomes using its own set of reels.

In one embodiment, a single slot machine may generate outcomes for multiple players during the same period of time. For instance, a slot machine may contain multiple pay lines. An outcome corresponding to a first pay line may belong to a first player, and an outcome corresponding to a second pay line may belong to a second player. The outcomes may thereby be generated at the same instant. Each pay line may even be labeled with an indicator of the player to whom the pay line corresponds. For instance, "Joe" is displayed on a liquid crystal display (LCD) next to a first pay line, and "Linda" is displayed next to a second pay line. Then, a player watching the slot machine via camera feed would know which pay line belonged to him.

In some embodiments, the same outcome may be applied to multiple players. For example, a casino attendant places a bet of fifty cents on behalf of Joe, and fifty cents on behalf of Linda, with both bets to be resolved by the same outcome on the same gaming device. If the outcome then is determined to be, say, "cherry-cherry-cherry," then both Joe and Linda receive the full payout for "cherry-cherry-cherry."

In another embodiment, half of a bet is contributed on behalf of Joe, and the other half on behalf of Linda. Then, upon the occurrence of a winning outcome, Joe and Linda each receive half of the corresponding payout. Of course, Joe and Linda may each contribute to a full bet in other proportions, e.g., ⅔ and ⅓, respectively.

In some embodiments, the accounting process for receiving multiple player bets on the same outcome may be simplified. For example, money from both players is pooled in a fixed proportion (e.g., one to one). Then, the pooled money is used to place bets on behalf of both of the players. Then, at the end of a session, any remaining money is divided between the players following the same proportion in which the money was pooled. In this way, there is no need to divide every individual payout among multiple player accounts, nor does a single bet need to be aggregated from multiple different accounts.

Figure 3:
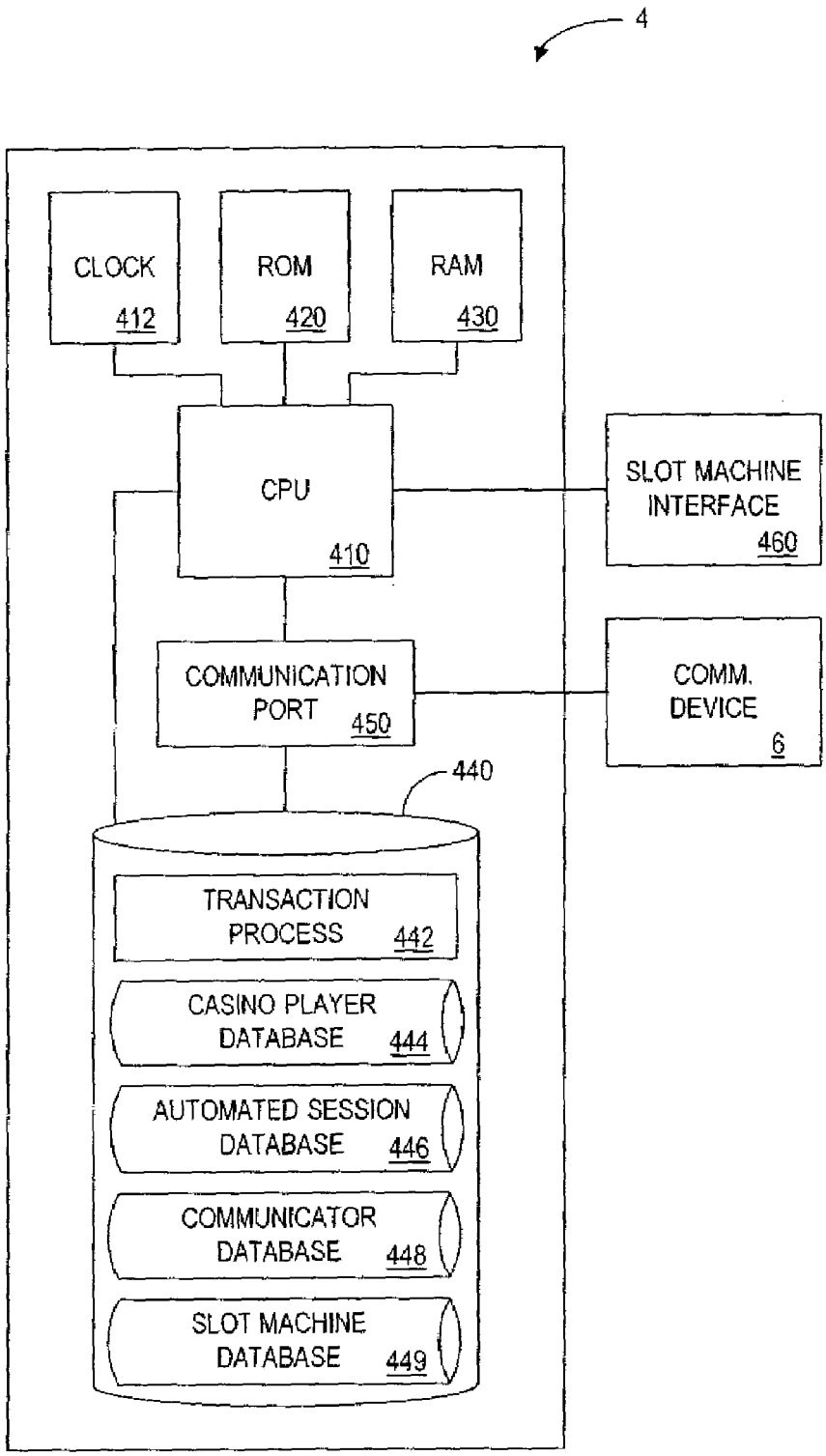
FIG. 3 is a schematic view of the slot network server of FIG. 1, including a player database, automated session database, communication device database, and slot machine database in accordance with one or more embodiments of the present invention.

With reference to FIG. 3, the slot network server 4 will be described in greater detail. Like the slot machine 2 of FIG. 2, the slot network server 4 has a Central Processing Unit (CPU) 410. The CPU 410, which has a clock 412 associated therewith, executes instructions of a program stored in Read Only Memory (ROM) 420. During execution of the program instructions, the CPU 410 temporarily stores information in the Random Access Memory (RAM) 430.

Additionally, the CPU 410 is coupled to a data storage device 440, having a transaction processor 442, a casino player database 444, an automated session database 446, a communication device database 448, and a slot machine database 449. In general, the transaction processor 442 manages the contents of the data storage devices 440. As discussed in detail below, the player database 444, automated session database 446, the communication device database 448, and slot machine database 449 store information related to player identification, automated operation of the slot machine 2, remote communication to the player's communication device 6, and slot machine outcomes, respectively.

In order to communicate with the communication device 6, the slot network sever 4 also includes a communication port 450. The communication port 450 is coupled to both the CPU 410 and the data storage device 440. Thus, the CPU 410 can control the communication port 450 to receive information from the data storage device 440 and transmit the information to the communication device 6. Note that the communication path between the communication port 450 and the communication device 6 need not be hardwired. As noted above, the communication device 6 is preferably a pager, a handheld device including a display (e.g., such as a PDA), or a cellular telephone, and preferably employs wireless communication.

Lastly, the slot network server 4 includes a slot machine interface 460 coupled to the CPU 410. The slot machine interface 460 allows the slot network server 4 to communicate with the slot machines 2 coupled to the network.

The player database 444 of the present embodiment as shown in FIG. 4, includes multiple records having multiple fields of information. Specifically, the player database 444 comprises multiple records, each record being associated with a particular player, as identified by a player identification (ID) code. The fields within each record include: name 4440, social security number 4441, player ID 4442, address 4443, telephone number 4444, credit card number 4445, credit balance 4446, complimentary information, such as complimentary points awarded 4447, hotel room number 4448, and player status rating 4449. Thus, having information related to one field, such as player ID 4442, allows the slot network server 4 to retrieve or access further information stored in the other fields of that player's record.

It is to be understood that not all of these identifying fields, nor the illustrated design of the player database 444, are necessary for operation of the present embodiment. Specifically, the name 4440, social security number 4441, player ID 4442, address 4443, telephone number 4444, credit card number 4445, and hotel room 4448 fields are merely representative of additional information that may be stored and used for other purposes. For example, in an alternative embodiment, credit card number 4445 and hotel room number 4448 are used for billing purposes and social security number 4441 is used to generate tax forms when a player wins a jackpot over a given amount.

Complimentary points awarded 4447 and player status rating 4449 are further illustrative of additional information a casino may store in a player's record Thus, in the present embodiment, only the player's name 4440, player ID 4442, and credit balance 4446 are necessary.

The automated session database 446, as shown in FIG. 5, comprises multiple records, each record pertaining to an automated play session of a particular player, as identified by the player ID. Consequently, one field in each record is the player ID field 4460. Other fields include: machine identification (ID) number(s) 4461, start time 4462, end time 4463, maximum number of pulls 4464, limiting credit balance 4465, limiting maximum payout 4466, bet per pull 4467, time between pulls 4468, and communication device number 4469. As will be apparent to one of ordinary skill in the art, since both the player database 444 and the automated session database 446 include a player ID field, 4440 and 4460, respectively, the system 1 can correlate any information stored in the player database 444, corresponding to a particular player, with any information stored in the automated session database 446, corresponding to that same player.

The communication device database 448, as shown in FIG. 6, includes multiple records, each record pertaining to a different communication device 6 as identified by a communication device number as stored in the communication device number field 4480. The additional fields in each record include: communicator identifier 4481, player ID 4482, communicator time out 4483, and communicator time in 4484. Because the communication device database 448 and the automated session database 446 both include a communication device number field 4481, 4469, respectively, information can be correlated between the two databases. Furthermore, because the communication device database 448, like the automated session database 446 and the player database 444, contains a player ID field 4482, the system 1 can correlate information contained within these three databases 444, 446, 448 for a particular player, as identified by the player ID.

In one embodiment of the present invention, the information stored in the communication device database 448 is used to inventory the communication devices 6. The communication time out 4483 represents the time at which a player removed a communication device 6 from a slot machine 2 and the communicator time in 4484 represents the time the communication device 6 was returned to the slot machine 2. Having such information, the slot network server 4 may, at any given time, search the communication device database 448 and determine which communication devices 6 are presently in use. Furthermore, for any communication device 6 that has been out for more than a given period, the server 4 may determine which player, based upon the player ID number in field 4482, last used the device 6. Moreover, based on the player ID number, the server 4 can obtain the information necessary to contact that player from that player's record in the player database 444.

As will be understood by those skilled in the art, the ultimate goal of most slot machine players is to hit a jackpot payout. The enjoyment of the play, as well as the ability to maximize the chance of hitting a large jackpot, is increased by more play. Play can be increased both by playing longer, and by playing faster. As will be appreciated from a consideration of the process described below, the present invention permits both increased duration and speed of play.

The slot machine database 449, as shown in FIG. 7, relates to information concerning each slot machine 2. As illustrated, each slot machine 2 has an associated record in the database. Each slot machine 2 is identified by a unique machine ID number, as stored in the machine ID number field 4491. The other fields in the slot machine database 449 include: machine type 4492, machine denomination 4493, maximum coins allowed 4494, payout structure 4495, reel positions 4496, and payout 4497. Because the slot network server 4 may search any field in the slot machine database 449, the server 4 is able to identify a slot machine 2, not only by its machine ID number 4491, but also by the type 4492 and denomination 4493 of the slot machine 2.

Figure 8A:
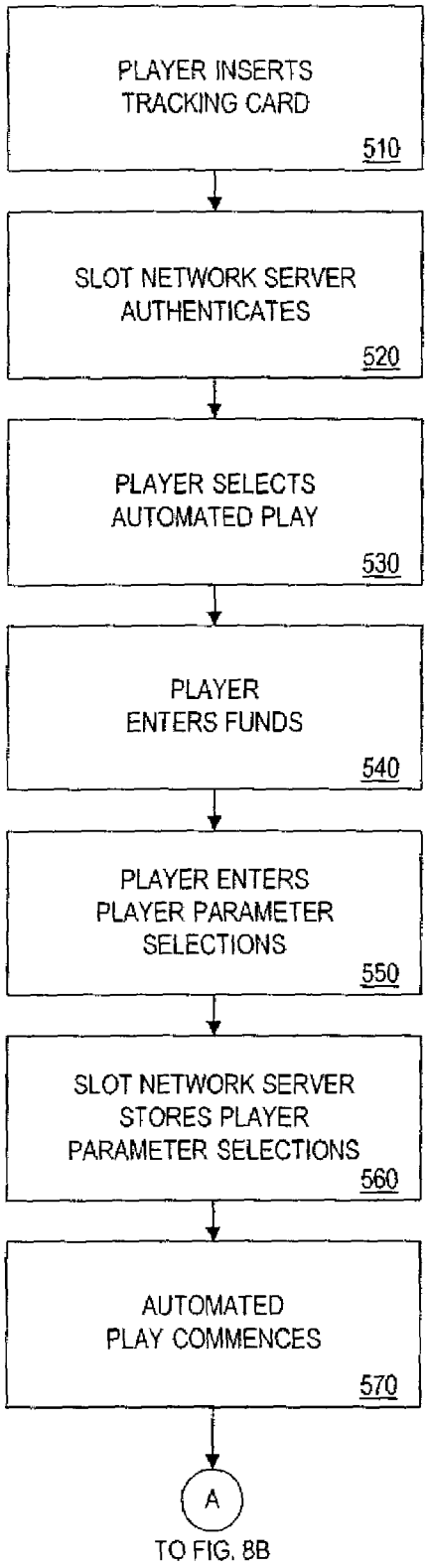
FIGS. 8A and 8B show an overall flow diagram of the operation of the system of FIG. 1 in accordance with one or more embodiments of the present invention.
Figure 8B:
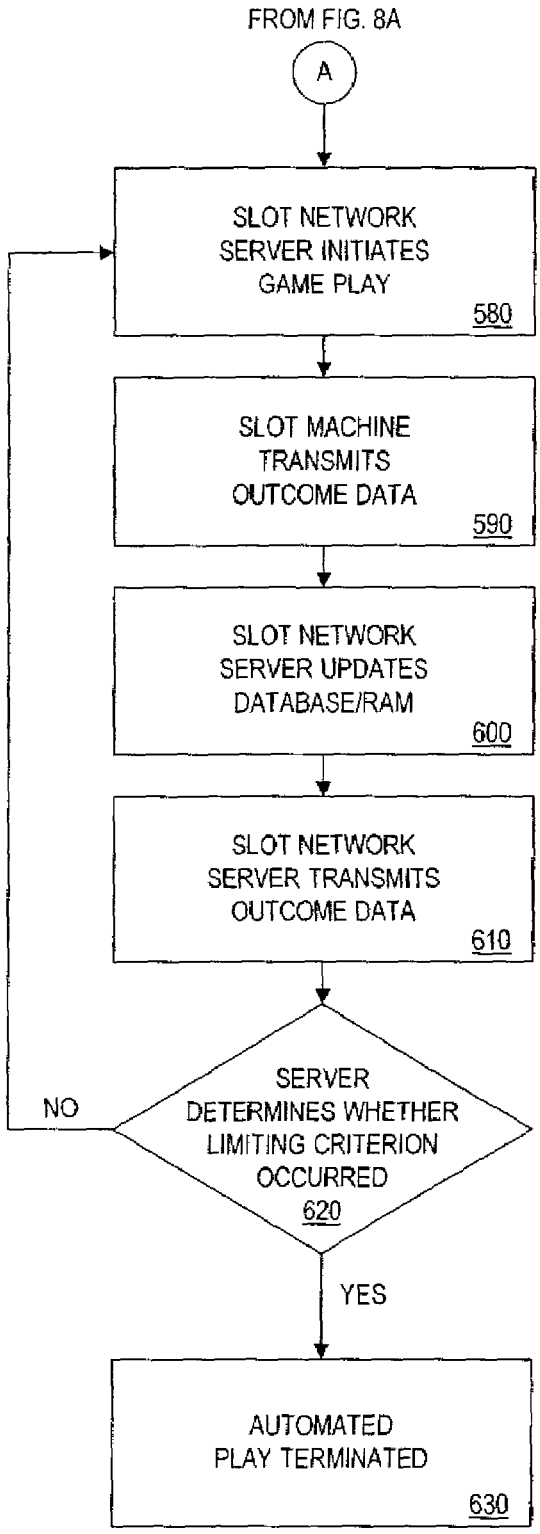

Having thus described the components of the present embodiment, the operation of the system 1 will now be described in greater detail with reference to FIGS. 8A and 8B, and continuing reference to FIGS. 1-7. It is to be understood that the programs stored in ROM 420 of the slot network server 4 and ROM 220 of the slot machine 2 provide the function described below.

As shown at step 510, the slot machine player first inserts the player tracking card 312 into the card reader 310. The card reader 310 then proceeds to read player identifier information from the tracking card 312. The player identifier information, namely the player's name and the player ID, are communicated from the slot machine 2 to the slot server 4. Upon receiving the player identifying information, the slot network server 4 authenticates the information. This step, depicted as step 520, includes the slot network server 4 searching the player database 444 for a record containing the player name and player ID received in the appropriate field 4440, 4442, respectively. Once the slot network server 4 authenticates the player identifying information, the server 4 transmits a signal to the slot machine 2 acknowledging such authentication.

In step 530, the player chooses to select automated slot machine play. According to various embodiments of the present invention, the player may choose to select automated slot machine play after receiving an offer of a reward in exchange for the player participating in an automated play session. The casino may provide such an offer in order to encourage automated play during nighttime hours when use of the slot machines is lower. Alternatively, the casino may provide such an offer during peak hours so as to free up a machine for other players. Of course, the casino may provide a reward for automated play in order to allow another player to use the slot machine manually, or to increase the number of players playing on the slot machine(s), whether remotely or manually (as discussed further below). A reward might be, for example, a bonus payout, a higher payout schedule, a meal compensation, a gift certificate, free credits, or the like.

The slot machine 2 also prompts the player to enter funds for use during the automated play session. Specifically, as shown in step 540, the player enters coins or bills into the slot machine 2. The slot machine 2 registers the total amount of money deposited by the player. The slot machine 2 then transmits a signal to the slot network server 4 indicating the amount of funds deposited by the player. In response, the slot network server 4 accesses the record in the player database 444 corresponding to the particular player and increments the credit balance field 4446 in accordance with the amount of finds deposited.

In the alternative, gaming credits accumulated during non-automated play of the slot machine 2 may be used to fund the automated play session. The slot machine 2, which locally stores the gaming credits in memory, transmits an indication of the amount of credits to the slot network server 4 for addition to the credit balance 4464.

In yet another alternative embodiment, the player, prior to initiating an automated play session, produces the player tracking card 312 at a slot change booth or casino cage and deposits a certain amount of funds. The casino personnel reads the player ID number from the player's tracking card 312 with a card reader and proceeds to access the record in the player database 444 corresponding to that player ID. The cashier then increments the credit balance field 4446 by the amount of funds just deposited.

In step 550 the remote player enters the player parameter selections. More specifically, the slot network server 4 transmits a signal to the slot machine 2 causing the slot machine 2 to display a prompt on the display 320 requesting that the player enter the player parameter selections. As noted above, the player preferably enters the player parameter selections via the touch screen on the display 320. In an alternative embodiment, the player enters the player parameter selection via keypad 330. In yet another alternative embodiment, the player parameter selections are previously stored in a record in the automated session database 446 as identified by the particular players player ID in field 4460. Alternatively, the player may enter the player parameter selections via communication device 6.

Player parameter selections include both play options and limiting criteria of play. Play options, as used herein, include any information used to define automated play. In the present embodiment, play options include the bet per game or handle pull and time between games or handle pulls, as stored in fields 4467 and 4468 of the automated session database 446. Other play options may include, for example, the type(s) of slot machine(s) to be played. For example, a player might request an automated play session including only games played at slot machines which had produced the most (or, alternatively, the fewest) wins in the last hour. Alternatively, the player may wish to define an automated play session that includes only games played by players from a specific geographic area.

A limiting criterion, on the other hand, is any information that may define the beginning or end of an automated play session. In the present embodiment, limiting criteria include: start time, end time, requested number of games or handle pulls, credit balance, total losses, total winnings, and limiting maximum payout. By definition, the expiration of all available credits/funding for playing the machine will, unless other arrangements are made in advance with the casino, constitute a limiting criteria of play. Similarly, the player may define a specific winning credit value as a limiting criteria of play (e.g., stop playing if a credit of one thousand dollars is ever registered).

Once the slot machine 2 receives the player preference selections, the slot machine 2 transmits the information to slot network server 4. The slot network server 4, as shown in step 560, proceeds to store the player parameter selections in the appropriate fields in the automated session database 446.

In addition to storing the player parameter selections, the slot network server 4 assigns an address in RAM 430 to keep current totals of actual limiting values. An actual limiting value is a value that corresponds to a limiting criterion of play. More specifically, an actual limiting value is the actual, current total of a criterion value necessary to determine whether any of the limiting criteria of play have occurred.

Thus, in the present embodiment, the slot network server 4 assigns an address in RAM 430 to store the number of games or handle pulls that actually occur during automated play. Additionally, the server 4 assigns an address in RAM 430 to store the actual amount of losses or winnings during automated play. Both the actual number of handle pulls and the actual amount of winnings or losses may be actual limiting values.

Furthermore, the current credit balance, which is stored in RAM 430, may also be an actual limiting value. As described below with reference to steps 590, 600 and 620, these actual limiting values are updated during automated play and used to determine whether a limiting criterion has occurred.

The server 4 may also assign an address in RAM 430 to store a time value corresponding to the play option of time between handle pulls 4468.

Next, in step 570, the automated play session commences. In one embodiment of the present invention, the commencement of automated play includes the slot network server 4 transmitting locking data to the slot machine 2. The locking data is a signal that prevents the slot machine 2 from accepting coins and entering manual mode. The locking data may also be a signal that prevents a player from pulling a pull handle or otherwise initiating a manual play of the slot machine 2.

Alternatively, locking data may be sent by slot network server 4, in accordance with the player's preferences, to a different slot machine than the slot machine 2 where the player entered funds and/or session parameters. Locking data may instead be sent by slot network server 4 to more than one slot machine, thereby enabling automated play of multiple locked-up slot machines in one automated session.

The slot network server 4 need not transmit locking data. If so, slot machine 2 is not locked and may be used by any player (including the player for whom automated play has commenced). In this manner, a casino may maximize the use of a particular slot machine (or slot machines).

For example, a typical slot machine 2 is capable of generating random numbers more frequently than a typical player initiates a game at the slot machine 2 (e.g., presses the starting controller 250). Thus, RNG 240 may generate a random number in response to an attending player pressing the starting controller 250 during a manual play, and may also generate a random number for a game of an automated play session while, for example, the spin reels 262, 264, and 266 are spinning for the manual play.

Alternatively, a random number generated by an attending player's manual play of slot machine 250 may be used to determine an outcome and/or a payout of a game of an automated play session. Thus, a single random number may be utilized in determining both an outcome of a game of a remote player's automated play session and an outcome and/or a payout of a game of the attending player. Similarly, a game of an automated play session may utilize the outcome and/or payout of a manually played game.

Thus, according to various embodiments of the present invention, an automated play session may include games played at a single locked-up slot machine, games played at multiple locked-up machines, games played at a slot machine (or slot machines) that is unavailable for manual play (e.g., that is for remote play only), games played at a slot machine (or slot machines) while the machine is also being manually operated, games played manually at a slot machine (or slot machines), or any combination of the above in accordance with player preferences and/or casino operation preferences.

Automated play may commence in various ways. The server 4 may initiate automated play of the game, as shown in step 580, if the player has entered a start time 4463 as a player parameter selection. Specifically, the slot network server 4 searches the automated session database 446 and compares the time from the clock 412 to the values stored in the start time field 4463 and the end time field 4464. If the internal clock time is equal to or greater than the value stored in the start time field 4463 and less than the value stored in the end time field 4464 (if such a value exists), then the slot network server 4 transmits a signal to the slot machine(s) 2 to initiate play.

Alternatively, the player may choose to begin automated play immediately upon entering the player parameter selections other than a start time 4462.

In step 590, the slot machine 2, having played a game and generated outcome data, as described above with respect to various embodiments, transmits the outcome data to the slot network server 4. Along with the outcome data, the slot machine 2 transmits its machine ID number so that the server 4 can identify from which machine the outcome data came. In various embodiments, multiple slot machines 2 transmit outcome data to the slot network server 2.

Outcome data, as used herein, means any information describing the outcome of a game or handle pull. In the present embodiment, outcome data includes the final position of each reel and the corresponding payout or loss for a given play.

According to various embodiments of the present invention, once the slot network server 4 receives the outcome data, it updates the player database 444 and the slot machine database 449 in step 600. More specifically, the slot network server 4 accesses the slot machine database 449 and updates the record pertaining to the particular slot machine 2, as identified by its machine ID number 4491. The slot network server 4 also accesses the automated session database 446 to determine the bet per pull 4466 for the particular player.

Lastly, the slot network server 4 accesses the player database 444 to update the credit balance field 4446 in the players record. The credit balance field 4446 is decreased by the bet per pull amount and increased by the payout 4497, if any.

In various embodiments, slot network server 4 stores outcome data in conjunction with information identifying the player associated with the outcome. In an embodiment where one player is playing a gambling session at the same time that another player has initiated an automated session at the same slot machine 2, each outcome stored may indicate both players (e.g. by player tracking card number). This allows subsequent audits to account for the fact that although one outcome was generated a corresponding revenue stream may be associated with two players. Alternatively, slot network server 4 may store the above information without the identities.

Once the slot network server 4 receives the outcome data, the server 4 also updates the actual limiting criteria stored in RAM 430, as needed. Specifically, the number of pulls value is incremented by one and the total losses/winnings value is changed to reflect the results of the last game.

In various embodiments of the present invention, the server 4 also stores the time it proceeds to step 610, as indicated by clock 412, as the time value corresponding to the time between handle pulls 4468. The server 4 uses this time value to determine the speed of play. Each subsequent time the system 1 performs the operations of step 600, the server 4 also determines whether, in light of the time between handle pulls 4468, it must delay before continuing to proceed. Specifically, the server 4 retrieves the time between handle pulls 4468 and the previously stored time value. The server only proceeds to step 610 when the current time, as indicated by the clock 412, equals the sum of the time between handle pulls 4468 and the previously stored time value. The server 4 stores the time it proceeds to step 610 as the new time value.

It is anticipated that a player having only a limited time remaining at a casino and a small amount of funds available will enter the minimum allowed time (e.g., "zero") as the time between handle pulls 4468. If such a value is received, the system 1 proceeds to continuously generate outcome data without delay, or with a minimal amount of time between generated outcomes, until a limiting criterion of play occurs. For example, the player enters the minimum allowed time as the time between handle pulls 4468 in step 550 and likely remains at the slot machine 2 to watch the slot machine 2 rapidly play game after game until, for example, the player is out of funds or wins a jackpot.

In various alternative embodiments of the present invention, the slot network server 4 compares received outcome data with a player's session parameters to determine if the game corresponding to the received outcome data should be included as a game in the player's automated play session. For example, a player may choose to include all games from a particular type of slot machine in his automated play session Thus, when the slot network server 4 receives outcome data corresponding to a game (whether automated or initiated manually) at a slot machine 2, it may include the game as part of the player's automated play session if the slot machine 2 is of the correct type.

Once the slot network server 4 receives the outcome data and updates the databases, the server 4 transmits the results of the play to the remote player communication device 6. The results communicated in step 610 to the player communication device 6 may include the actual reel position 4496, the payout of a particular game 4496, the player's current credit balance 4446, and any other information stored or generated by the system 1.

Alternatively, the results may be stored by the server 4 and communicated, for example, at a specific time, periodically, upon the player's request, or in accordance with a player's selection parameters. Similarly, the results, once received by the communication device 6, may be stored and displayed, for example, at a specific time, periodically, upon the player's request, or in accordance with a player's selection parameters.

The slot network server 4 establishes communication with a communication device 6 that is associated with the particular player. Specifically, the server 4 accesses the communication device database 448 and searches for the communication device number 4480 equal to that stored in the players record in the automated session database 446 in field 4469. The server 4 then uses the communication identifier 4481, which is the pager or cellular telephone number, or the internet protocol (IP) address of a set-top device, to establish communication with the communication device 6.

Note that in various embodiments, more than one communication device 6 may be associated with the particular player. Thus, results may be transmitted to a player's cellular telephone, PDA, pager, and/or other devices, for example, on a player's "buddy list".

As described above, in one embodiment of the invention communication device 6 comprises a pager with a liquid crystal or other type of display. This communication of the outcome data to the player, which may even include a display of the reel position outcome on the display, permits a player to enjoy the excitement of the play without a physical presence at the device. Further, such essentially real-time communication with the slot machine permits a player to adjust the limiting criteria to maximize enjoyment and potential return, typically by increasing the speed and duration of play.

In one aspect of the invention, the remaining credit balance is communicated to the player along with the outcome data. Thus, when a player notes that his play may be terminated because his credit balance is running out, he has the opportunity to increase the credit balance. Preferably, the player will return to a slot machine and add further moneys. If returning to a slot machine is not convenient, the player can increase the credit balance by phoning the casino and authorizing the casino personnel to increase the credit balance. The casino personnel will appropriately enter the additional funds into the correct server database fields. If returning to a slot machine is convenient, the player may choose simply to return to the machine and add more coins. Alternatively, the player may increase the credit balance by sending a command to the casino, the slot machine 2, the server 4, or other device, via, e.g., a two-way pager or touch-tone wireless telephone.

In step 620, having just completed one play, the slot network server 4 determines whether a limiting criterion has occurred. Specifically, in the present embodiment, the slot network server 4 accesses the record in the automated session database 446, as identified by the player's ID 4460, to determine whether any one of the limiting criteria have occurred.

The determination of whether any of the limiting criteria have occurred may be made by various comparisons, for example, by comparing any of: 1) the end time 4464 to an internal clock of the server 4; 2) the maximum number of pulls 4464 to the actual number of pulls stored in RAM 430; 3) the current credit balance 4446 to the limiting credit balance 4465; and 4) the limiting maximum payout 4466 to the actual payout 4497. If none of the limiting criteria have occurred, operation of the system 1 proceeds from step 580, once again.

If any one of the limiting criteria has occurred, then, in step 630, the slot network server 4 stops the automated play session and transmits a signal to the communication device 6, thereby notifying the player that the automated session has ended. If the slot machine 2 was locked-up during the automated session, it may remain locked-up until the player returns. In an alternative embodiment, the slot network server 4 also transmits an unlocking signal to the slot machine 2 upon the occurrence of a limiting criterion of play. The unlocking signal indicates to the slot machine 2 that it may accept coins and allow other players to commence play.

In yet another embodiment, information other than outcome data, such as machine messages, is communicated to the communication device 6. Machine messages, as used herein, include information generated by the slot machine 2 relating to the status of that particular slot machine 2. For example, such a machine message may indicate that the slot machine 2 has stopped functioning properly, is being played manually, or is being played automatically by another player.

In yet another embodiment of the present invention, limiting criteria of play, actual limiting values, or both, are communicated to the player. For example, the player will be notified of the current credit balance 4446 and the limiting credit balance 4465, as well as the current number of pulls, as stored in RAM 430, and the maximum number of pulls 4464 allowed.

In an alternative embodiment, the outcome data transferred in step 590 of FIG. 8 need only include the payout 4497, if any. In such an alternative embodiment, the slot machine 2 communicates only the payout information to the slot network server 4. The server 4, in turn, accesses a slot machine database 449 and, based upon the machine ID number transmitted, accesses a record for that slot machine 2. A payout structure for that particular slot machine 2 is maintained within the record. The payout structure, like the payout table 284 in the slot machine 2, correlates the payout received from slot machine 2 to a possible reel result.

For example, if reels 262, 264, 266 of the slot machine 2 reveal "cherry-cherry-bar," the slot machine 2 may determine that, according to the payout table 284, the player should receive a payout of ten coins. The slot machine 2 then communicates to the slot server 4 a payout of ten coins. The server 4, by accessing the payout structure, correlates the payout of ten coins back into the reel positions of "cherry-cherry-bar." Because several reel positions may correspond to the same payout, the slot network server 4 may determine that a reel position other than "cherry-cherry-bar" occurred. Thus, the server 4 simulates the actual outcome of the slot machine 2 for transmission to the player's communication device 6.

It will be appreciated by those skilled in the art that, while the player may select player parameter selections in the manner described above, the casino may also set guidelines on the automated operation of the slot machines. In general, the casino is desirous of maximizing play on, and hence revenue from, each machine. Thus the casino may limit the selectable range of player parameter selections, for example the frequency of handle pulls, to insure reasonably constant and speedy play. Further, the casino may alter the range of player parameter selections, and even the fundamental operation of the machines, to encourage play during times when the machine is otherwise underutilized. For example, the casino may permit a machine to be played during late night hours, in an automated mode, at a slower speed and with a higher payout schedule. This would permit a player to start automated play during the nighttime hours when the machine would be otherwise unused. The casino hours would benefit from increased play and revenue, while the player would benefit from potentially better payouts.

Figure 9:
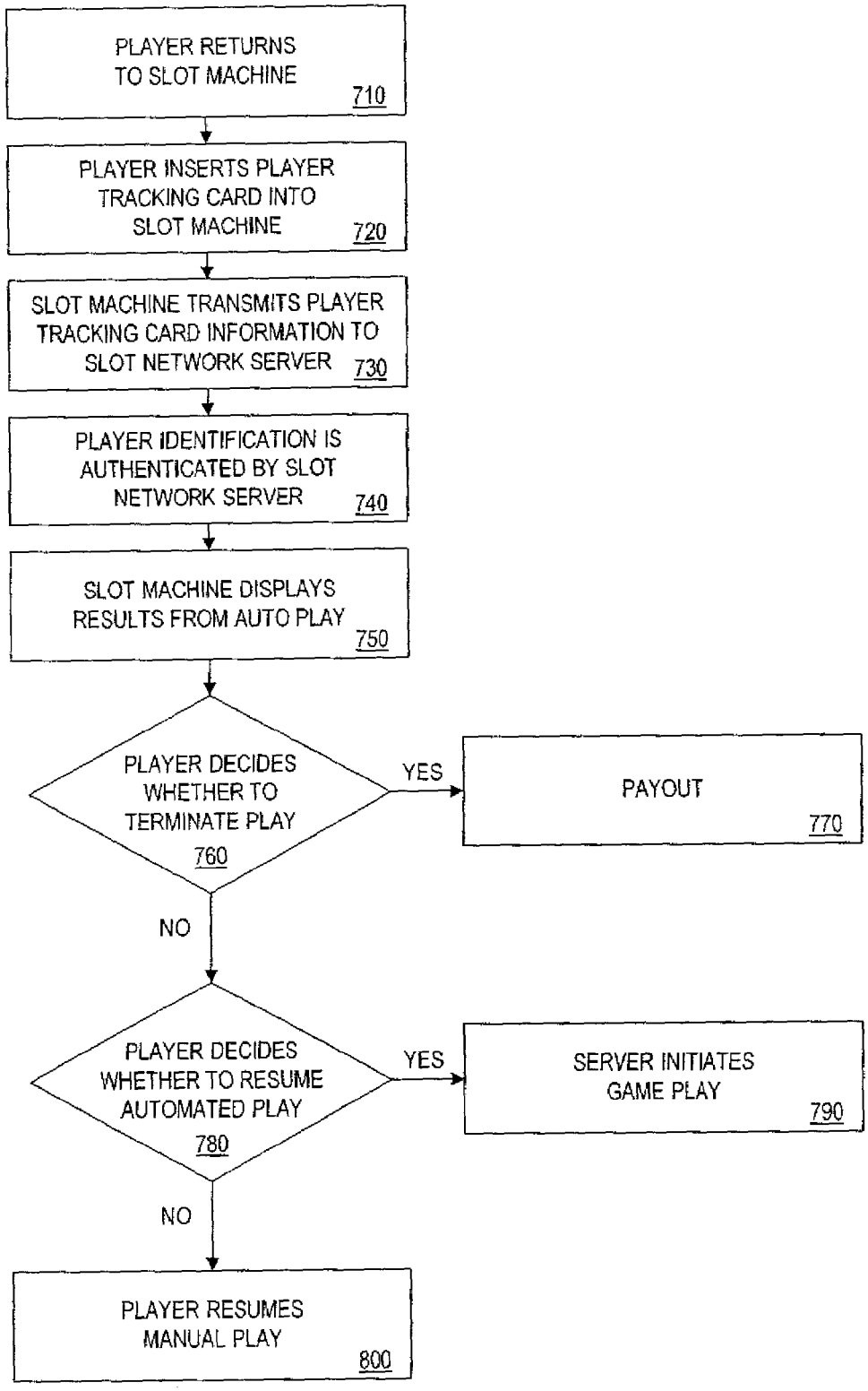
FIG. 9 is a flow diagram of the system of FIG. 1, illustrating termination of automated play in accordance with one or more embodiments of the present invention.

At any time during the operation of the system 1, as described with reference to FIG. 8, the player may return to the slot machine 2 and manually terminate automated play. Such manual termination of automated play will now be described with reference to FIG. 9.

Upon returning to the machine 2, as shown in step 710, the player, in step 720, inserts the player tracking card 312 into the card reader 310. The card reader 310 reads the player identifying information from the player tracking card 312 and, in step 730, the slot machine 2 transmits this player identifying information to the slot network server 4.

In step 740, the slot network server authenticates the player identifying information. Specifically, the slot network server 2 searches the automated session database 446 to determine whether the player ID number and the machine ID number just received are also present in a single record in the automated session database 446. If the information is present in a single record in the automated session database 446, the player identifying information is deemed authentic.

In an alternative embodiment, the player may terminate his automated play session by returning to any available slot machine 2, regardless of whether the slot machine 2 was involved in the automated play session. Accordingly, the player identifying information may be deemed authentic if the player ID number is in at least one record in the automated session database 446.

Having authenticated the player identifying information, the slot network server 4 transmits the results from the automated play to the slot machine 2 for display to the player in step 750. The results, which are displayed on display 320 or, alternatively, video display area 270, preferably include the player's credit balance 4464. The displaying of the results may also include, for example, all of the resulting reel positions or only the winning reel positions. These results may also be made available to the player via the communication device 6. Having read the results from the automated play session, as shown as step 760, the player may then decide to terminate play. In step 770, if the player decides to terminate play, then the player may receive a payout owed.

It will be understood that, should the player so desire, a complete audit of the automated play session is available through an appropriate examination of the contents of slot machine database 449. Such an audit would typically be provided by casino personnel upon special request by the player, and could include a complete reporting of results for every play during the automated session.

On the other hand, if the player decides not to terminate play, then the player must decide whether to resume automated play, as shown in step 780. If the player decides to resume automated play, such play will continue as described with reference to FIG. 8, steps 580-630, until a limiting criterion occurs or the player returns to manually terminate play. The resumption of automated play is shown as step 790.

As an alternative to resuming automated play, the player may decide instead to resume manual play of the slot machine 2. Step 800 illustrates the resumption of manual play.

As shown in step 770, the player may receive any payout 4497 due. Receiving the payout may involve the slot machine 2 dispensing the amount of coins equal to the credit balance 4464 for the player. Note that the slot machine 2 may or may not be the same slot machine at which the player initiated his automated play session. In an alternative embodiment, the payout involves the player returning to the slot change booth or casino cage and presenting the player tracking card 312. The casino personnel proceed to read the player ID and player name from a player tracking card 312. Upon verifying the players identification with a secondary form of ID, such as a driver's license, the personnel access the player database 444. The casino personnel proceed to pay the player any amount less than or equal to the current credit balance 4446 stored in the player's record. The personnel then adjust the credit balance 4446 to reflect the disbursement.

In another alternative embodiment, the player may receive a prize or reward in lieu of the payout 4497 due. For example, the casino may offer the player a free hotel stay in lieu of the payout 4497 due. Such an offer may be communicated to the player, for example, by the casino personnel, via the communication device 6, or via the display 320 of the slot machine 2. Of course, such an offer may be communicated via the communication device 6 during automated play.

In some embodiments, some or all of the slot machine outcomes are not generated automatically for a player, but may be generated manually on behalf of a player by a casino representative. In one embodiment, the casino representative plays just as any other person would, but the casino representative is gambling with the player's money. The casino representative might begin by inserting money provided by the player into a slot machine. The casino representative might then make a number of handle pulls specified by the player. If any coins drop into the coin tray, then the casino representative may reinsert them into the slot machine. After the specified number of handle pulls, the casino representative might then cash out any remaining player money from the slot machine. Finally, the casino representative may send a check for the remaining amount of money to the player, or may give the money to the player directly.

In the above embodiment, there is potential for fraud on behalf of casino representatives. For example, a casino representative might simply keep all of a player's starting money, and later tell the player that all the money was lost to the slot machine. Even if a casino representative is not dishonest, there is always the potential that a player will suspect dishonesty, and will protest a loss, or will simply not remain a customer of the casino. Therefore, casino representatives may follow special procedures designed to minimize fraud.

Figure 11:
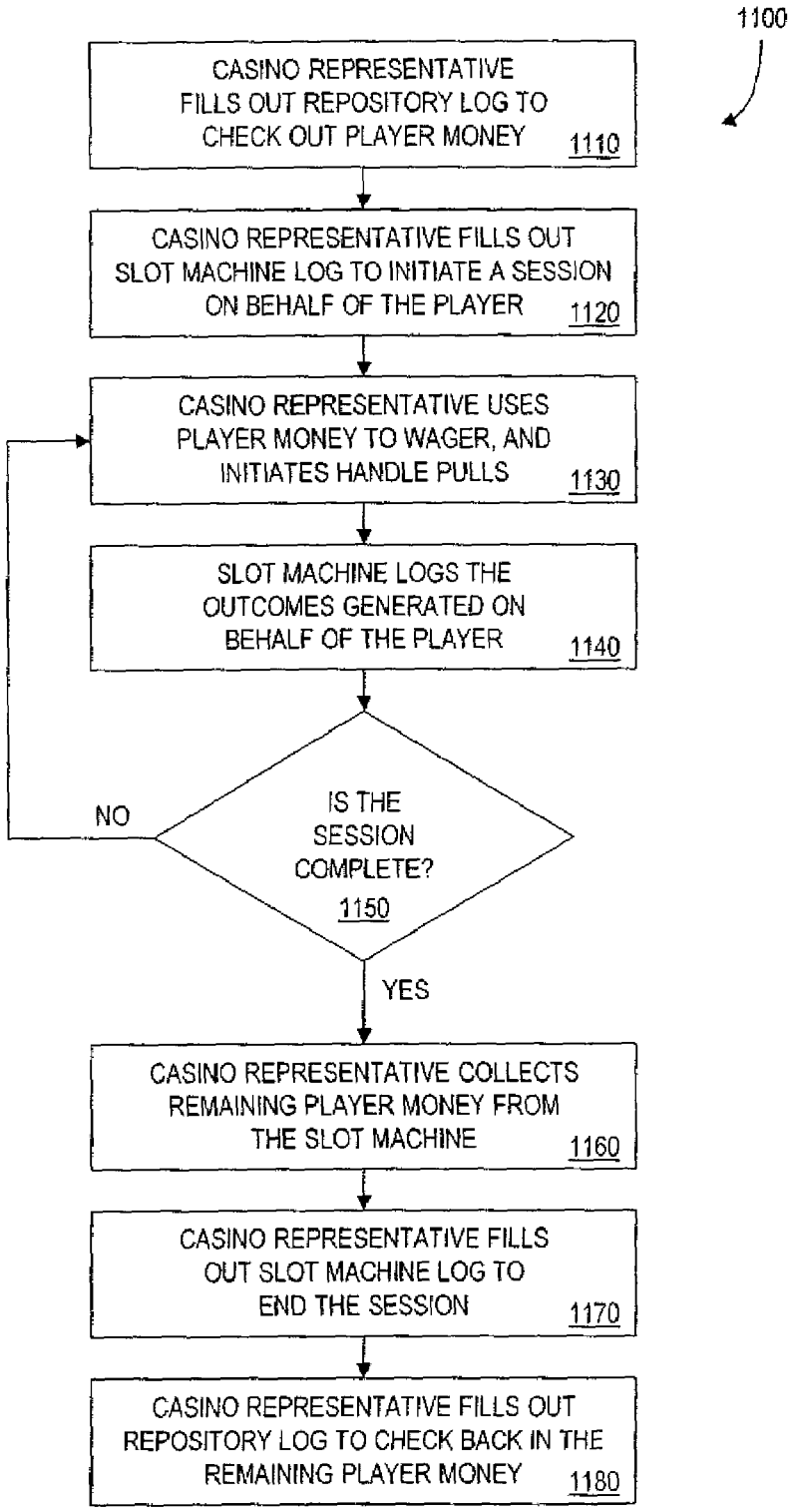
FIG. 11 is a flow diagram describing an exemplary method in accordance with one or more embodiments of the present invention.

In one embodiment, a casino representative may perform any one or more of the following steps in the process of gambling on behalf of the player, as depicted in FIG. 11. At step 110, a casino representative checks out an amount of cash, tokens, or other currency from a repository in the casino. The amount may be specified by the player. In the checkout process, the casino representative fills out information in a log, such as the exemplary log depicted in FIG. 12. The information may detail the amount of money checked out 1260, the name of the player on behalf of whom the money is checked out 1240, the time and date 1270, the name of the casino representative 1220, and so on. The casino representative might confirm his own identity by, for instance, providing a signature, identification number 1230, fingerprint, or password for the log. The casino representative might also swipe an identification card through or near a card reader to confirm his identity. The log itself may be on paper or other material, or it may be electronic.

The session identification number field 1210 in FIG. 12 provides a reference tag for a particular session during which a casino representative has placed bets on behalf of a player. The play contract identification number field 1250 identifies the contract that has prompted the current session to be played on the player's behalf For example, a player might have entered into a contract authorizing the casino to place bets on the player's behalf, using $1000 of the player's money, over the course of a two-hour session. The field 1250 identifies the relevant contract.

Once the casino employee has checked out money on behalf of a player, the casino representative may proceed to a slot machine. As illustrated in step 1120, once at the slot machine, the casino representative may again input information into a log. This time, the log (not shown) may be associated with the particular slot machine, so that each slot machine may have its own separate log. However, there may be a single log for multiple slot machines. Information placed into the log associated with the slot machine may include the name of the casino representative, the name of the player on whose behalf the casino representative plays, the time at which the session is initiated, the number of handle pulls to be made, the amount of money with which the casino representative is beginning the session, information confirming the identity of the casino representative, and so on. Once again, the log may be paper or electronic.

The casino representative might also use a special identification card inserted into the player tracking card reader. This card might even have information about the remote wagering session encoded onto the card. Based on information read from the inserted card, the slot machine may be able to automatically update its associated log.

The casino representative may then proceed to initiate handle pulls on behalf of the player (step 1130). For each handle pull, the slot machine may record outcome information in the slot machine log (step 1140). Outcome information may include the indicia comprising the outcome, the amount paid out, whether the payout was in cash, credits, or tokens, the time and date at which the outcome was generated, and so on. The slot machine may also log information about the amount bet on each handle pull, and about any amount inserted or cashed out over the course of the session. In an alternative embodiment, the casino representative manually logs outcome information himself.

Once the casino representative has finished a session (step 1150), the casino representative may cash out any credits remaining with the slot machine (step 1160). The casino representative may then fill additional information into the log of the slot machine (step 1170). This information may include the time and date at which the session is being concluded, the number of handle pulls completed, the amount of money remaining at the conclusion of the session, the name of the player on whose behalf the session was played, the name of the casino representative, and any identifying information about the casino representative. Information provided to the slot machine log may be input manually by the casino representative, or automatically by the slot machine.

In some embodiments, once a session has been finished on a slot machine, a new session may not be initiated on the same slot machine for a predefined transition period. The period may last, for example, five minutes. The purpose of the transition period is to make it clear that play on behalf of a first player on a slot machine has completely finished, and that subsequent play on the same slot machine is made on behalf of a new player. In this way, a first player cannot easily complain, for example, that a jackpot won during a second player's session belongs to him.

When a casino representative has finished a session at a slot machine, the casino representative may then proceed to another slot machine. For example the player may have left instructions for sessions to be played on his behalf at multiple slot machines. The casino representative may then repeat the process of signing in to the new slot machine's log, playing the session, and then signing out of the slot machine's log.

Once the casino representative has finished playing sessions on behalf of a player, the casino representative may check any remaining player money back into the repository (step 1180). To do so, the casino representative may make an entry in the repository log, indicating the time and date at which money is being returned (1290), the amount of money being returned (1280), the name of the player to whom the money belongs, the name of the casino representative, and any other required identifying information about the casino representative. The casino representative may also provide information describing the sessions played on behalf of the player. For instance, the representative may provide the identifiers of the slot machines at which he played, the number of handle pulls made at each slot machine, the amount won or lost at each slot machine, and so on.

A subsequent audit performed by another casino representative, by the player, or by the third party might compare the logs from the various slot machines to the repository log. If all is well, the difference between the amount removed from the repository, and the amount returned to the repository on behalf of a player will exactly equate to the total amounts won or lost on behalf of the player at the various slot machines.

In one embodiment, the casino representative is tracked on film as he goes through the process of checking out money, playing sessions, and returning money to the repository. Cameras monitoring the casino representative may be overhead, or may be part of the slot machine. Casino representatives may additionally wear identifiers that make them easily identifiable on camera. For instance a casino representative may wear a bright red badge. Then, a player or an auditor remotely viewing a feed of a casino floor from a camera would be able to identify and follow the actions of any desired casino representative.

In one embodiment, when a casino representative plays a session on behalf of a player, the casino representative inserts the player's tracking card into the gaming device. This allows the player to receive comp points for his play, and also allows the slot machine to automatically log the name of the player on behalf of whom a session is played. The casino representative may be in possession of a player tracking card left with the casino by the player, or the casino representative may be in possession of a duplicate player tracking card.

Any of the aforementioned log entries made by the casino representative may be done in an automated fashion. In fact, if a casino representative is not involved, then all log entries may be made in an automated fashion. For example, the slot network server may log a one hundred credit deduction from a player account. The slot network server may then transmit the credit and player information to a slot machine, which logs that one hundred credits have been added to the machine on behalf of the player. The slot machine may then follow player provided instructions, and log each outcome. Finally, the slot machine may log the end of the session, including the amount of credits the player has at the conclusion of the session. Then the slot machine may transmit the credit information back to the slot network server, which logs the credits as being deposited back into the player's account, the time of deposit, and so on.

In some embodiments, some or all log entries are transmitted to the relevant player or to a third party, such as an auditor. Log entries may be transmitted substantially as they are made, or may be delayed.

In addition to the auditing features described above, various procedures may be set in place to assure that a casino representative gaming on behalf of a player faithfully follows a player's given instructions. To this end, whenever a casino representative begins a session at a slot machine, the slot machine may download player instructions from the slot network server. The slot machine may then prevent the casino representative from performing any unauthorized actions. For example, if a casino representative attempts to bet fifty cents on a single handle pull, and the player has instructed that bets be only twenty-five cents per handle pull, then the slot machine may fail to execute the handle pull. Alternatively, the slot machine may only register the first twenty-five cents bet and use a payout table for the outcome corresponding to a twenty-five cent bet.

In some embodiments, the slot machine displays a message to the casino representative when the representative fails to accurately execute an instruction. The message might say, "John has requested that you double the bet after a win. Please bet another credit." In other embodiments, the slot machine displays instructions to the casino representative prior to every action the casino representative takes. In this way, the casino representative need not remember player instructions, and need not refer to an instruction sheet, but need only follow the instructions on the display of the slot machine. In may be noted that presumably, if a slot machine is intelligent enough to instruct the casino representative as to exactly what to do, and to prevent the casino representative from doing otherwise, then the slot machine may as well execute all player instructions automatically. However, there may be good reasons for having player instructions executed manually by a casino representative. For example, a player may be less distrustful of a human playing on his behalf than of a machine playing on his behalf.

It is to be understood that the present invention is not limited to an embodiment including both the slot machine 2 and the slot network server 4. Specifically, in one embodiment of the present invention, a slot machine alone stores the automated play information, including player identifying information, credit balance, player parameter selections, and actual limiting values. Moreover, the slot machine not only generates outcome data, but also, rather than employing a server, internally updates the information as described above.

Furthermore, the present invention encompasses automated play of gaming devices that require a player to make decisions during play, such as video blackjack machines, video poker machines, and the like. The inclusion of decision rules in the player parameter selections accounts for the need to make decisions. Alternatively, decision rules may be applied to all players or may be otherwise outside of the control of the player. For example, all players playing an automated play session, or a certain subset of such players, may be forced to play according to a predetermined set of decision rules. Decision rules dictate the course of play based upon the current status of play. For example, decision rules for automated play of a video blackjack machine include staying when the dealer shows a "six" and playing according to the highest odds of winning. In short, because decision rules obviate the need for player decisions, automated play may proceed.

In an alternative embodiment, outcomes requiring a decision by the player may be stored and displayed to the player at a later time, for example, when the player returns to the slot machine 2, or via the communication device 6 at the player's request. After the outcome requiring a decision is stored, automated play may then continue with the next game. For example, some outcomes of reel slot machine games require the player to make a selection in a bonus round. In accordance with this alternative embodiment, then, automated play could continue without the player's selection. The player could then play all the stored bonus round outcomes requiring the player's selection at a later time.

According to some embodiments, a slot machine may include a means for recording audit information. Audit information may include records of outcomes generated by the machine, a number of credits won or lost by a player as a result of the outcomes, and the identities of players who have had outcomes generated using the simplified slot machine. For example, a simplified slot machine is automatically generating outcomes for John, a remote player. The machine may record, for a particular outcome, that the outcome was generated for John, that twenty-five cents was wagered, that the outcome was generated at 3:39:27.596 p.m., Dec. 18, 2004, that the outcome generated was "cherry-cherry-bell," and that five 25-cent credits were added to John's account.

In one embodiment, a slot machine records audit information on a tangible medium, such as a paper tape. The machine may therefore contain a printer, such as a laser printer or dot matrix printer, through which a paper tape is fed. Then, information about each outcome generated may be printed as a separate line on the tape. In another embodiment, audit information is recorded in a memory device, such as RAM, magnetic memory, or optical memory. In another embodiment, audit information is recorded at the slot network server. Therefore, the slot machine may transmit any audit information, such as the outcome generated, the time of generation, and so on, to the slot network server.

In another embodiment, a slot machine with reels may be configured so as to cause the reels to shift from one outcome to another using a minimal number of rotations. For example, a first reel of a slot machine currently displays "CHERRY," and must display "LEMON" for the next outcome. If the lemon is three stops after the cherry, then the reel need only spin three stops before displaying "LEMON." In contrast, a slot machine on a casino floor might typically spin the first reel multiple times before it stopped on "LEMON." Not only may a reel spin a minimal number of rotations, but it may also spin in the direction that would most quickly or most efficiently bring the reel to the desired stop. Therefore, in the above example, if the "LEMON" symbol had been three stops after the "CHERRY" symbol, the reel might have spun backwards in order to stop on the "LEMON" symbol.

In some embodiments, a remote player's play session may be in the process of executing, either automatically or under the control of a casino representative, when something goes wrong. Examples of what might go wrong include: the machine executing the play session breaks down; the machine runs out of coins; and the power goes out in the casino; the video feed from the machine to the remote player gets interrupted; etc. When something goes wrong, the slot machine may be programmed to immediately log the player's balance on the machine, the time at which the interruption occurred, the player's name, the name of the casino representative conducting the session, and any other pertinent information. For example, the slot machine may contain a backup power supply, such as a battery, with enough stored energy to record audit data following a general loss of power. If the log is maintained in electronic form, then the slot machine may also cause log information to be printed. Alternatively, the slot machine may transmit log information to the slot network server, or to the remote player.

In particular, a remote player viewing the generation of his outcomes may be concerned during an unexpected interruption. At such times, the slot network server or the slot machine may assuage the player concerns by sending the player a reassuring message, perhaps via a communications channel that has not been effected by the interruption. For example, the slot network server might send to the player an email message saying, "We have had a break in service due to a machine malfunction, and we apologize for the interruption. However we assure you that your money is safe and accounted for, and we will hopefully be able to resume service shortly." The message may further spell out the amount of money the player had in his bankroll at the time of the interruption, may provide a number the player can call with further questions, and so on.

In some embodiments, a player will have specified a particular slot machine on which his play session is to be executed. For instance, the player may perceive slot machine number 52248 to be a lucky machine because his date of birth was May 22, 1948. The loss of a lucky slot machine due to breakdown or other interruption may therefore be cause for significant concern for a player. A player may therefore specify, in his play session or otherwise, one or more backup machines to be used should his first choice of machines break down. In this way, a player who loses a lucky machine to malfunction may fall back on another lucky machine, rather than having his play session executed on just any arbitrary machine.

As mentioned, should anything go wrong with a player's play session being executed on a first machine, the player's play session may be taken up by a backup machine. The backup machine may receive log information from the original machine, or from the slot network server, which may have received the log information from the original machine. The backup machine may then make an entry in its own logs, showing that it has taken up a play session, and showing the state of the play session when the play session was taken up. For instance, the backup machine shows that it has taken up a 100-spin play session on the 63rd spin, having taken the play session from machine number 52248.

In one embodiment, two or more cameras are used to detect when something has gone wrong with a player's play session being executed on a slot machine. The slot machine may be either a simplified slot machine or a standard slot machine on the floor of a casino. In this embodiment, the two or more cameras are focused on the slot machine. The cameras each produce video feeds of activity at the slot machine. For example, the cameras may produce video feeds showing the reels of the slot machine, the credit meter of the slot machine, the payout meter, the coin tray, the bonus screen, etc. Another discrepancy would occur if two video cameras were monitoring the same feature of a slot machine, such as its reels. One video camera might provide a feed showing an outcome of "cherry-cherry-cherry," while the other camera might provide a feed showing an outcome of "cherry-cherry-bar." Upon detecting a discrepancy, the monitor may send a signal to the slot machine to stop executing the play session until the discrepancy in the video feeds can be fully investigated. The monitor may further send a signal to casino personnel in the vicinity of the slot machine to investigate the discrepancy. In this embodiment, microphones or other sensors may be used in place of, or in addition to video cameras. For example, a microphone may monitor the sound effects emanating from the slot machine. If a video feed of the slot machine indicates a large payout, but the microphone does not indicate sound effects consistent with a large payout, then a monitor may determine that something has gone wrong with the execution of a play session at the slot machine.

In some alternative embodiments, the slot network server includes a scraping device interface coupled to the CPU. Scraping devices may include any devices that can be affixed to a slot machine or placed in proximity to a slot machine, and that can retrieve information from the slot machine. For example, a scraping device may comprise a small camera that can be attached to a slot machine and can be directed at the outcome display area (e.g., the reels) of the slot machine. A scraping device may retrieve information by monitoring an outcome display area, a credit meter, a payout meter, a coin tray, or any other non-static feature of a slot machine. The scraping device may detect electromagnetic signals, acoustic signals, vibrations, and other signals produced by a slot machine. The scraping device may interpret such signals using a processor and software contained on a ROM, both internal to the scraping device. For example, a scraping device monitoring a payout meter may detect a change in light emissions from the payout meter, and interpret the change, using optical character recognition technology, to mean that a player at the slot machine has just won 10 credits.

A scraping device may also comprise a piece of hardware or software residing within the slot machine. Although it may be internal to the slot machine, a scraping device may not receive any direct signals from the processor of the slot machine. Instead, the scraping device may interpret outputs from the processor of the slot machine that have been sent to the reel controller, hopper controller, video display area, or other features of the slot machine. The scraping device may communicate any information it has retrieved from a slot machine to the slot network server via the slot network and the scraping device interface.

Embodiments where the slot network server communicates with the scraping device provide advantages in that the slot network server need not communicate directly with a slot machine in order to e.g., track the progress of a player's play session. Therefore, a slot machine need not be retrofitted just to connect to the slot network. Instead, a scraping device can be attached to the slot machine.

One type of scraping device is a screen scraper, typically embodied as a computer program. A screen scraper is often used to translate data from the output of a first program into data suitable to be used by a second program. The translation process is used because the two programs operate on data that is formatted differently, and so cannot communicate directly with one another. The translation process occurs, in one case, when the older program outputs data to be displayed in a first format on a display screen, such as a CRT display. The screen scraper reads the data, and translates it from the first format to a second format. The screen scraper may then provide the data in the second format to the newer program, which can now understand the data and perform operations on the data that perhaps were not possible with the older program.

There has thus been provided a method and apparatus of operating a gaming device, for example a slot machine, in an automated manner. The present invention permits a casino to significantly increase the usage and revenue of such gaming devices, encouraging substantially continuous play at times when the machine might otherwise be un- or under-used. The invention further permits a player to enjoy all of the benefits of gambling, such as the enjoyment of viewing real-time gaming device results, without necessitating a physical presence at the machine. Additionally, the invention permits the casino to offer better-than-normal playing parameters, such as an improved payout schedule, or even the special reservation of a selected machine during normal playing hours.

Although the present invention has been described in terms of certain preferred embodiments, other embodiments that are apparent to those of ordinary skill in the art are also intended to be within the scope of the present invention. Accordingly, the scope of the present invention is intended to be limited only by the claims appended hereto.

What we claim is:

1. A computer readable medium storing instructions configured to direct a computing device to perform a method, the method comprising:

determining data representative of at least one of:

an end time, a maximum number of plays, a wager amount, and a rate of play;

initiating automated play of at least one slot machine, in which at least one of the at least one slot machine is not availabe for manual play at least during the automated play;

terminating the automated play of the at least one slot machine based on the data;

receiving a first signal including a representation of the automated play;

receiving a request from a remote player to view the representation of the automated play; and transmitting a second signal including the representation of the automated play for the remote player.

2. A system comprising:

a processor;

at least one slot machine in communication with the processor; and a storage device in communication with the processor, the storage device storing instructions configured to direct the processor to:

determine data representative of at least one of:

an end time, a maximum number of plays, a wager amount, and a rate of play;

initiate automated play of the at least one slot machine, in which at least one of the at least one slot machine is not availabel for manual play at least during the automated play;

terminate the automated play of the at least one slot machine based on the data;

receive a first signal including a representation of the automated play;

receive a request from a remote player to view the representation of the automated play; and transmit a second signal including the representation of the automated play for the remote player.

3. The system of claim 2, the instructions being further configured to direct the processor to:

transmit locking data to the at least one slot machine.

4. The system of claim 2, in which at least one of the at least one slot machine is not operable for manual play.

5. The system of claim 2, in which at least one of the at least one slot machine is not accessible by any player.

6. The system of claim 2, the instructions being further configured to direct the processor to:

enable manual play of at least one of the at least one slot machine after terminating the automated play.

7. The system of claim 2, in which a first slot machine of the at least one slot machine is stacked on top of a second slot machine.

8. The system of claim 2, in which at least one of the at least one slot machine comprises a first casing that is replaceable with a second casing.

9. The system of claim 2, in which transmitting the second signal comprises:

determining a communication device that is associated with the remote player; and transmitting the second signal to the communication device.

10. The system of claim 9, in which the communication device comprises a handheld device.

11. The system of claim 9, in which the communication device comprises a telephone.

12. The system of claim 9, in which the communication device is associated with an internet protocol address.

13. The system of claim 2, in which transmitting the second sigal comprises:

transmitting the second signal via wireless communication.

14. The system of claim 2, in which transmitting the second signal comprises:

transmitting the second signal to a display device.

15. The system of claim 2, in which the first signal comprises a video signal.

16. The system of claim 2, in which the first signal is received from a camera.

17. The system of claim 16, in which the camera is operable to view the automated play of at least one of the at least one slot machine.

18. The system of claim 17, in which the camera is configured to be operable by the remote player.

19. The system of claim 2, in which transmitting comprises:

transmitting the second signal in response to a request from the remote player.

20. The system of claim 2, in which at least one of the at least one slot machine comprises a machine identifier.

21. The system of claim 20, in which the machine identifier is viewable by the remote player.

22. The system of claim 2, in which at least one of the at least one slot machine comprises an indicator of activity.

23. The system of claim 22, in which the indicator of activity comprises at least one of:

a source of light, a source of light having a color that is associated with the remote player, a flag, and a text message.

24. A computer readable medium storing instructions configured to direct a computing device to perform a method, the method comprising:

receiving data associated with a remote player, the data representative of at least one of:

a wager amount, and a maximum number of plays;

initiating automated play of a slot machine;

terminating the automated play of the slot machine base on the data;

receiving a first video signal from a camera, in which the first video signal indicates at least one outcome of the automated play;

generating a second video signal that indicates the at least one outcome of the automated play;

determining at least one communication device that is associated with the remote player; and transmitting the second video signal to the at least one communication device.

25. A system comprising:

a processor;

a slot machine in communication with the processor; and a storage device in communication with the processor, the storage device storing instructions configured to direct the processor to:

receive data associate with a remote player, the data representative of at least one of:

a wager amount, and a maximum number of plays;

initiate automated play of the slot machine;

terminate the automated play of the slot machine based on the data;

receive a first video signal from a camera, in which the first video signal indicates at least one outcome of the automated play;

generate a second video signal that indicates the at least one outcome of the automated play;

determine at least one communication device that is associated with the remote player; and transmit the second video signal to the at least one communication device.

* * * * *